US011957160B2

(12) United States Patent
Rousseau et al.

(10) Patent No.: US 11,957,160 B2
(45) Date of Patent: Apr. 16, 2024

(54) FILLER CONTAINING BLENDS OF AEROSOL GENERATING MATERIALS

(71) Applicant: Mativ Holdings, Inc., Alpharetta, GA (US)

(72) Inventors: Cedric Rousseau, Le Mans (FR); Cedric Jardin, Le Mans (FR); Doriane Bigot, Le Mans (FR)

(73) Assignee: Mativ Holdings, Inc., Alpharetta, GA (US)

( * ) Notice: Subject to any disclaimer, the term of this patent is extended or adjusted under 35 U.S.C. 154(b) by 409 days.

(21) Appl. No.: 16/788,056

(22) Filed: Feb. 11, 2020

(65) Prior Publication Data

US 2020/0253269 A1 Aug. 13, 2020

Related U.S. Application Data

(60) Provisional application No. 62/803,886, filed on Feb. 11, 2019.

(51) Int. Cl.
*A24B 15/16* (2020.01)
*A24B 15/24* (2006.01)
(Continued)

(52) U.S. Cl.
CPC ..... *A24D 1/18* (2013.01); *A24B 15/16* (2013.01); *A24B 15/24* (2013.01); *A24B 15/303* (2013.01); *A24D 1/02* (2013.01)

(58) Field of Classification Search
CPC ..... A24B 15/16; A24B 15/24; A24B 15/303; A24B 15/165; A24B 15/283; A24D 1/01;
(Continued)

(56) References Cited

U.S. PATENT DOCUMENTS 2,418,296 A 4/1947 Frederickson
3,012,914 A 12/1961 Battista et al.
(Continued)

FOREIGN PATENT DOCUMENTS

CN 1179922 4/1998
CN 103161091 6/2013
(Continued)

OTHER PUBLICATIONS

U.S. Appl. No. 10/178,872, filed Jan. 15, 2019, Mompon.
(Continued)

*Primary Examiner* — Galen H Hauth
*Assistant Examiner* — Yana B Krinker
(74) *Attorney, Agent, or Firm* — Dority & Manning, P.A.

(57) ABSTRACT

An aerosol generating material is disclosed containing a blend of at least two plant fibers or aerosol generating materials. The reconstituted material can contain at least one of extracted cannabis fibers and extracted cocoa husk fibers, in combination with at least one of extracted tobacco fibers, tobacco materials, extracted herbal plant fibers, and aerosol generating herbal plant materials. The reconstituted plant fiber material is capable of generating an aerosol, such as a smoke, that has a very mild and neutral or natural taste without any harsh components. The reconstituted plant fiber material contains no nicotine, low or no amounts of other active compounds, such as THC, and contains low to no amounts of harsh combustible compounds, such as tar.

14 Claims, 1 Drawing Sheet

(51) Int. Cl.

| | |
|---|---|
| ***A24D 1/18*** | (2006.01) |
| *A24B 15/30* | (2006.01) |
| *A24D 1/02* | (2006.01) |

(58) Field of Classification Search

CPC .. A24D 1/18; A24D 1/02; A24F 42/10; A24F 42/60

See application file for complete search history.

(56) References Cited

U.S. PATENT DOCUMENTS

| | | | | |
|---|---|---|---|---|
| 3,100,492 | A | 8/1963 | Schmidt | |
| 3,203,432 | A | 8/1965 | Green et al. | |
| 3,429,316 | A | 2/1969 | Hess et al. | |
| 4,201,228 | A | 5/1980 | Lewinger | |
| 4,279,824 | A | 7/1981 | McKinney | |
| 4,306,578 | A * | 12/1981 | Schmidt | A24B 15/30 131/357 |
| 4,459,998 | A | 7/1984 | Labbe | |
| 4,681,126 | A | 7/1987 | Strubel et al. | |
| 4,719,929 | A | 1/1988 | Breckwoldt | |
| 4,813,438 | A | 3/1989 | Fleming | |
| 4,969,477 | A | 11/1990 | Yagisawa | |
| 4,987,906 | A | 1/1991 | Young et al. | |
| 5,119,836 | A | 6/1992 | White | |
| 5,135,010 | A | 8/1992 | Fan | |
| 5,143,097 | A | 9/1992 | Stephen Sohn et al. | |
| 5,159,942 | A | 11/1992 | Brinkley et al. | |
| 5,203,355 | A | 4/1993 | Clearman et al. | |
| 5,322,076 | A | 6/1994 | Brinkley et al. | |
| 5,323,791 | A | 6/1994 | Wu et al. | |
| 5,325,877 | A * | 7/1994 | Young | A24B 15/12 131/370 |
| 5,339,838 | A | 8/1994 | Young et al. | |
| 5,377,698 | A | 1/1995 | Litzinger et al. | |
| 5,501,237 | A | 3/1996 | Young et al. | |
| 5,513,663 | A | 5/1996 | Van Leuven et al. | |
| 5,533,530 | A | 7/1996 | Young et al. | |
| 5,562,108 | A | 10/1996 | Hardy et al. | |
| 5,715,844 | A | 2/1998 | Young et al. | |
| 5,908,034 | A | 6/1999 | Adedeji | |
| 6,289,897 | B1 | 9/2001 | McAdam et al. | |
| 6,679,270 | B2 | 1/2004 | Baskevitch et al. | |
| 6,699,288 | B2 | 3/2004 | Moret | |
| 7,323,197 | B1 | 1/2008 | Lukacs | |
| 7,428,905 | B2 | 9/2008 | Mua | |
| 7,836,896 | B2 | 11/2010 | Nadimi | |
| 8,047,209 | B2 | 11/2011 | May | |
| 8,469,038 | B2 | 6/2013 | Sinclair, Jr. | |
| 8,646,461 | B2 | 2/2014 | Von Borstel et al. | |
| 8,813,760 | B2 | 8/2014 | May, Jr. | |
| 8,897,628 | B2 | 11/2014 | Conley et al. | |
| 9,022,041 | B2 | 5/2015 | Marsi | |
| 9,095,173 | B2 | 8/2015 | Sinclair, Jr. | |
| 9,220,298 | B1 | 12/2015 | En'Wezoh et al. | |
| 9,428,757 | B2 | 8/2016 | Senger et al. | |
| 9,433,240 | B2 | 9/2016 | Sinclair, Jr. | |
| 9,462,829 | B2 | 10/2016 | Van Den Berg | |
| 9,474,725 | B1 | 10/2016 | Reillo et al. | |
| 9,532,593 | B2 | 1/2017 | Turner | |
| 9,655,381 | B2 | 5/2017 | Sinclair, Jr. | |
| 9,675,103 | B2 | 6/2017 | Sinclair, Jr. | |
| 9,839,612 | B2 | 12/2017 | Reillo et al. | |
| 9,956,911 | B2 | 5/2018 | Wright | |
| 9,972,680 | B2 | 5/2018 | Reillo et al. | |
| 9,974,739 | B2 | 5/2018 | Reillo et al. | |
| 10,016,360 | B1 | 7/2018 | Elbogen et al. | |
| 10,076,135 | B2 | 9/2018 | Lisauskas et al. | |
| 10,080,385 | B2 | 9/2018 | Sinclair | |
| 10,165,795 | B2 | 1/2019 | O'Malley | |
| 10,172,897 | B2 | 1/2019 | Vu et al. | |
| 10,206,427 | B2 | 2/2019 | Pijnenberg et al. | |
| 10,226,066 | B2 | 3/2019 | Moldoveanu et al. | |
| 10,271,578 | B2 | 4/2019 | John et al. | |
| 10,639,439 | B2 | 5/2020 | Larson | |
| 10,729,662 | B2 | 8/2020 | Ragot et al. | |
| 10,750,773 | B2 | 8/2020 | Yang et al. | |
| 2004/0103908 | A1 | 6/2004 | Prakash et al. | |
| 2005/0056294 | A1 * | 3/2005 | Wanna | A24B 3/14 131/370 |
| 2005/0263165 | A1 | 12/2005 | Oh et al. | |
| 2006/0021626 | A1 | 3/2006 | Mua | |
| 2008/0000488 | A1 | 1/2008 | Nadimi et al. | |
| 2009/0050165 | A1 | 2/2009 | Murali | |
| 2012/0095088 | A1 | 4/2012 | Hospodor | |
| 2012/0152264 | A1 | 6/2012 | Coleman et al. | |
| 2012/0318286 | A1 | 12/2012 | Lisauskas et al. | |
| 2014/0166028 | A1 | 6/2014 | Fuisz et al. | |
| 2014/0216481 | A1 | 8/2014 | Freeman | |
| 2014/0295049 | A1 | 10/2014 | Ragot et al. | |
| 2014/0360520 | A1 | 12/2014 | May | |
| 2015/0037389 | A1 | 2/2015 | Ragot et al. | |
| 2015/0068544 | A1 | 3/2015 | Moldoveanu et al. | |
| 2015/0083142 | A1 | 3/2015 | Sinclair, Jr. | |
| 2015/0107614 | A1 | 4/2015 | Sinclair, Jr. | |
| 2015/0374030 | A1 | 12/2015 | Lisauskas et al. | |
| 2016/0029690 | A1 | 2/2016 | Sinclair | |
| 2016/0037823 | A1 | 2/2016 | Ruben | |
| 2016/0193266 | A1 | 7/2016 | Ablett | |
| 2016/0255854 | A1 | 9/2016 | Rousseau | |
| 2016/0302474 | A1 | 10/2016 | Chen et al. | |
| 2016/0366926 | A1 * | 12/2016 | Uren | A24B 3/12 |
| 2017/0035095 | A1 | 2/2017 | Zuchuat et al. | |
| 2017/0112187 | A1 | 4/2017 | Ostrander | |
| 2017/0112188 | A1 * | 4/2017 | Ostrander | A24D 1/02 |
| 2017/0112189 | A1 | 4/2017 | Stern | |
| 2017/0119039 | A1 | 5/2017 | Dena et al. | |
| 2017/0172201 | A1 | 6/2017 | Turner | |
| 2017/0174404 | A1 | 6/2017 | Ragot et al. | |
| 2017/0181466 | A1 | 6/2017 | Batista | |
| 2017/0188623 | A1 | 7/2017 | Cranford | |
| 2017/0202895 | A1 | 7/2017 | Hugh | |
| 2017/0202896 | A1 | 7/2017 | Hugh | |
| 2017/0245542 | A1 | 8/2017 | Zappoli | |
| 2017/0258128 | A1 | 9/2017 | Lisauskas et al. | |
| 2017/0273347 | A1 | 9/2017 | Klipfel et al. | |
| 2017/0273349 | A1 | 9/2017 | Moore | |
| 2017/0303576 | A1 | 10/2017 | Rousseau | |
| 2017/0333503 | A1 | 11/2017 | Ayres | |
| 2017/0347699 | A1 | 12/2017 | Sinclair, Jr. | |
| 2018/0027869 | A1 | 2/2018 | Scott | |
| 2018/0116276 | A1 | 5/2018 | Prog et al. | |
| 2018/0137792 | A1 | 5/2018 | Gransaull | |
| 2018/0168224 | A1 | 6/2018 | Naughton et al. | |
| 2018/0213838 | A1 | 8/2018 | Richmond et al. | |
| 2018/0233558 | A1 | 8/2018 | Reillo et al. | |
| 2018/0271826 | A1 | 9/2018 | Sievers et al. | |
| 2018/0279666 | A1 | 10/2018 | Aoun et al. | |
| 2018/0325972 | A1 | 11/2018 | Moore | |
| 2018/0344790 | A1 | 12/2018 | Vu et al. | |
| 2018/0352848 | A1 | 12/2018 | Vu et al. | |
| 2018/0360099 | A1 | 12/2018 | Ibrahim | |
| 2018/0360103 | A1 | 12/2018 | Kaplan et al. | |
| 2019/0022158 | A1 | 1/2019 | Greenbaum et al. | |
| 2019/0145050 | A1 | 5/2019 | Rousseau et al. | |
| 2019/0262304 | A1 | 8/2019 | Townsend et al. | |
| 2019/0380377 | A1 | 12/2019 | Rabes | |
| 2020/0035118 | A1 * | 1/2020 | Pandolfino | A24F 40/20 |
| 2020/0101013 | A1 | 4/2020 | Ragot et al. | |
| 2020/0179269 | A1 | 6/2020 | Tamir et al. | |
| 2020/0197639 | A1 | 6/2020 | Larson | |
| 2020/0205463 | A1 | 7/2020 | Lamblin | |
| 2020/0253264 | A1 | 8/2020 | Rousseau et al. | |
| 2020/0253266 | A1 | 8/2020 | Rousseau et al. | |
| 2020/0253267 | A1 | 8/2020 | Rousseau et al. | |
| 2020/0253268 | A1 | 8/2020 | Rousseau et al. | |
| 2020/0275688 | A1 | 9/2020 | Rousseau | |
| 2020/0297023 | A1 | 9/2020 | Billon et al. | |

FOREIGN PATENT DOCUMENTS

| | | |
|---|---|---|
| CN | 103704882 | 4/2014 |
| EP | 0336458 | 10/1989 |
| EP | 0337506 | 10/1989 |

(56) References Cited

FOREIGN PATENT DOCUMENTS

| | | | |
|---|---|---|---|
| EP | 0339689 | | 11/1989 |
| EP | 0271036 | | 3/1992 |
| EP | 1797779 | | 6/2006 |
| EP | 1420659 | | 6/2007 |
| IN | 3540DEL2012 | | 12/2012 |
| JP | 2017525422 | A | 9/2017 |
| JP | 2017538410 | A | 12/2017 |
| JP | 2019502366 | A | 1/2019 |
| WO | WO2002047494 | | 6/2002 |
| WO | WO2003020057 | | 3/2003 |
| WO | WO2004043173 | | 5/2004 |
| WO | WO2004068974 | | 8/2004 |
| WO | WO2006097447 | | 9/2006 |
| WO | WO2011127679 | | 10/2011 |
| WO | WO2011127680 | | 10/2011 |
| WO | WO2014106819 | | 7/2014 |
| WO | WO2016026810 | | 2/2016 |
| WO | WO2016050873 | | 4/2016 |
| WO | WO2016171997 | | 10/2016 |
| WO | WO2018143952 | | 8/2018 |
| WO | WO2018178978 | | 10/2018 |
| WO | WO2020/097430 | | 5/2020 |

OTHER PUBLICATIONS

Co pending U.S. Appl. No. 16/998,514, filed Aug. 20, 2020.
Translation of Japanese Office Action Corresponding to Application No. 2021-546669 on Feb. 6, 2024.

* cited by examiner

FILLER CONTAINING BLENDS OF AEROSOL GENERATING MATERIALS

RELATED APPLICATIONS

The present application is based on and claims priority to U.S. Provisional Patent Application Ser. No. 62/803,886, filed on Feb. 11, 2019, which is incorporated herein by reference.

BACKGROUND

Conventional smoking articles combust a material at temperatures that release active compounds, which are inhaled through the mainstream smoke. The mainstream smoke delivered to the user not only has a characteristic, enjoyable, taste, but also can deliver to the user active compounds that are absorbed into the blood through the lungs that can provide the smoker with a pleasant and calming effect. However, in the past, it has been difficult to control the amount of active compounds, such as nicotine, delivered to a user by an article, and harder yet to maintain good sensory characteristics, such as taste and smell, while modifying the amount of active compounds contained in the article.

Various different methods have been proposed to control active agents, such as nicotine. For example, one method for removing nicotine from tobacco is through chemical extraction. Nicotine can be removed from tobacco, for instance, using a relatively harsh solvent extraction process that is similar to removing caffeine from coffee beans. The extraction process, however, not only removes nicotine but also removes various other components from the tobacco material. For instance, nicotine extraction processes also remove flavorings and can be detrimental to the taste of the tobacco. The extraction method is also relatively expensive and time consuming.

In addition to solvent extraction, genetically modified tobacco plants have recently been developed that inherently have low nicotine levels. Genetically modified tobacco plants, however, cannot only be expensive to grow and harvest, but are also susceptible to contamination through crossbreeding with regular tobacco plants. Cross pollination, for instance, can reverse the low nicotine effects of the genetically modified plant. Thus, genetically modified plants must be grown in areas that are completely isolated from other tobacco crops.

Additionally, modification of active compounds and/or flavoring compounds has become even more difficult when the smoking article includes cannabis and/or hemp, as limiting or metering levels of tetrahydrocannabinol (THC) and/or cannabidiol (CBD) while maintaining a good or authentic taste has been difficult to achieve. For instance, THC and/or CBD deliveries can vary dramatically depending upon the particular plant and the particular plant parts being burned, further increasing the difficulty in controlling delivery. Simply rolling cannabis material in a rolling paper, for instance, can lead to drastic non-uniformity differences in delivery based upon many factors including the paper used, packing densities, the parts of the plants used, the manner in which the plants have been prepared, and the like. Further, in addition to THC and CBD, cannabis contains over 60 different cannabinoid compounds and over 400 other different compounds that may give the product a bad taste and/or a harsh smoking experience.

Furthermore, as it has proven difficult to control taste and active material content in reconstituted materials, there is also a lack of blends and variety available in aerosol generating articles. Particularly, there are a lack of blends that use two or more aerosol generating materials to form a combustible article which maintains good sensory characteristics, such as satisfactory or natural taste and smell, and which also may exhibit control over the active compounds contained within the smoking article.

In view of the above, a need currently exists for a combustible material or aerosol generating material that combines fibers, or aerosol generating materials, from two or more plant sources or materials. It would also be beneficial to provide a combustible material or aerosol generating material that combines fibers and/or aerosol generating materials from two or more plant that also controls or minimizes at least one active compound contained in the aerosol generating material. Furthermore, it would also be advantageous to provide an aerosol generating material that minimizes one or more active compounds, but that also maintains natural or pleasant sensory characteristics.

SUMMARY

In general, the present disclosure is directed to an aerosol generating material that includes a reconstituted plant material containing a mixture of at least two different plant fibers. The reconstituted plant material includes: (a) extracted cannabis fibers, including cannabis leaves, cannabis stems, cannabis buds, cannabis flowers, cannabis seeds, or by-products or residues of cannabis extraction, or mixtures thereof, (b) extracted cocoa husk fibers, or (c) mixtures thereof, combined with (a) extracted tobacco fibers, including tobacco leaves, tobacco stems, by-products of tobacco extraction, or mixtures thereof, (b) extracted herbal plant fibers, or (c) mixtures thereof.

In one embodiment, for instance, the reconstituted plant material contains the extracted cannabis fibers combined with the extracted tobacco fibers. Additionally or alternatively, the reconstituted plant material contains the extracted cocoa husk fibers combined with extracted tobacco fibers. Moreover, in an embodiment, the reconstituted plant material contains a mixture of the extracted cannabis fibers combined with the extracted cocoa husk fibers. Furthermore, in yet another embodiment, the reconstituted plant material contains the extracted herbal plant fibers, where the extracted herbal plant fibers are obtained from coffee, tea, vine, ginger, ginkgo, chamomile, tomato, ivy, mate, rooibos, cucumber, a cereal, turmeric, clove, licorice, sandalwood, cinnamon, mint, cilantro, cumin, thyme, or mixtures thereof.

Additionally or alternatively, in an embodiment, the reconstituted plant material can further include web building fibers. Further yet, the web building fibers can include flax fibers, hemp fibers, abaca fibers, softwood fibers, hardwood fibers, bamboo fibers, coconut fibers, ramie fibers, jute fibers or mixtures thereof. In an embodiment where web building fibers are used, the web building fibers are present in the reconstituted plant material in an amount greater than about 3% by weight, such as in an amount greater than about 5% by weight, such as in an amount greater than about 8% by weight, and in an amount less than about 40% by weight.

In one embodiment, the reconstituted plant material has been treated with a humectant. In an embodiment where a humectant is used, the humectant includes glycerol, propylene glycol, or mixtures thereof. Furthermore, in an embodiment where a humectant is used, the humectant is present in the reconstituted plant material in an amount of 5% by weight or less, and/or the humectant is present in the reconstituted plant material in an amount of 5% by weight or greater, such as in an amount of about 10% by weight or greater, such as in an amount of about 15% by weight or greater, and in an amount of about 50% or less.

In an embodiment where the reconstituted plant material includes extracted cannabis fibers, the extracted cannabis fibers contain less than 0.3% by weight tetrahydrocannabinol.

In yet a further embodiment, the aerosol generating material includes an aerosol delivery composition applied to the reconstituted plant material, where the aerosol delivery composition contains an aerosol delivery agent. In an embodiment that includes an aerosol delivery composition, the aerosol delivery agent can include a drug or a flavorant. In a further embodiment, the aerosol delivery agent can include an oil or a solid, and in yet a further embodiment, the aerosol delivery agent includes nicotine, tetrahydrocannabinol, cannabidiol, or mixtures thereof. Additionally or alternatively, the aerosol delivery agent includes a sugar, a licorice extract, honey, a coffee extract, maple syrup, a tea extract, a botanical extract, a plant extract, a tobacco extract, or a fruit extract. In one aspect, the aerosol delivery agent can comprise one or more terpenes. A terpene or a blend of terpenes can be added to the reconstituted cannabis material in order to impart a distinct aroma that indicates a high quality cannabis product. Terpenes that can be added to the reconstituted cannabis material include pinene, humulene, b-caryophyllene, isopulegol, guaiol, nerylacetate, neomenthylacetate, limonene, menthone, dihydrojasmone, terpinolene, menthol, phellandrene, terpinene, geranylacetate, ocimene, myrcene, 1,4-cineole, 3-carene, linalool, menthofuran, perillyalcohol, pinane, neomenthylaceta, and substantial others.

In an embodiment that includes an aerosol delivery composition, the aerosol delivery composition is present on the reconstituted plant material in an amount greater than about 1% by weight, such as greater than about 3% by weight, such as greater than about 5% by weight, such as greater than about 10% by weight, such as greater than about 15% by weight, such as greater than about 20% by weight, such as greater than about 25% by weight, such as greater than about 30% by weight, such as greater than about 35% by weight, such as greater than about 40% by weight, and less than about 50% by weight.

In an embodiment according to the present disclosure, the reconstituted plant material has a basis weight of from about 40 gsm to about 120 gsm, such as from about 55 gsm to about 85 gsm.

Additionally or alternatively, in an embodiment of the present disclosure, the aerosol generating material is in the form of a filler material that includes a strip, strips, shreds, or mixtures thereof of the reconstituted plant material.

In general, the present disclosure also includes a smoking article. The smoking article includes an outer wrapper surrounding a smokeable rod, where the smokeable rod includes an aerosol generating material according to any of the above embodiments. In one embodiment, the wrapper includes a plurality of discrete reduced ignition areas being spaced along an axial direction of the smoking article, the reduced ignition areas having a diffusivity of less than about 0.5 cm/s at 23° C. In an embodiment that includes a plurality of reduced ignition areas, the plurality of reduced ignition areas have been formed by applying a reduced ignition composition to the wrapper. In a further embodiment, when the smoking article is tested according to ASTM Test E2187-09, at least 75% of the smoking articles self-extinguish.

In general, the present disclosure may also include a smoking article that includes a heating device and a chamber, the chamber containing the aerosol generating material as defined in any of the embodiments described above. The heating device is positioned so as to heat the aerosol generating material for producing an inhalable aerosol without burning the aerosol generating material.

Furthermore, the present disclosure is also generally directed to an aerosol generating material that includes a reconstituted plant material. The reconstituted plant material includes: (a) extracted cannabis fibers, including cannabis leaves, cannabis stems, cannabis buds, cannabis flowers, cannabis seeds, or by-products or residues of cannabis extraction, or mixtures thereof, (b) extracted cocoa husk fibers, or (c) mixtures thereof. The reconstituted plant material is blended with (a) extracted tobacco fibers, including tobacco leaves, tobacco stems, by-products of tobacco extraction, or mixtures thereof, (b) extracted herbal plant fibers, or (c) mixtures thereof.

In one embodiment, for instance, the reconstituted plant material contains the extracted cannabis fibers. Additionally or alternatively, the reconstituted plant material contains the extracted cocoa husk fibers. Moreover, in an embodiment, the reconstituted plant material contains a mixture of the extracted cannabis fibers combined with the extracted cocoa husk fibers. Additionally or alternatively, the reconstituted plant material is blended with the tobacco material. Furthermore, in yet another embodiment, the reconstituted plant material contains the extracted herbal plant fibers, where the extracted herbal plant fibers are obtained from coffee, tea, vine, ginger, ginkgo, chamomile, tomato, ivy, mate, rooibos, cucumber, a cereal, turmeric, clove, licorice, sandalwood, cinnamon, mint, cilantro, cumin, thyme, or mixtures thereof.

Additionally or alternatively, in an embodiment, the reconstituted plant material can further include web building fibers. Further yet, the web building fibers can include flax fibers, hemp fibers, abaca fibers, softwood fibers, hardwood fibers, bamboo fibers, coconut fibers, ramie fibers, jute fibers or mixtures thereof. In an embodiment where web building fibers are used, the web building fibers are present in the reconstituted plant material in an amount greater than about 3% by weight, such as in an amount greater than about 5% by weight, such as in an amount greater than about 8% by weight, and in an amount less than about 40% by weight.

In one embodiment, the reconstituted plant material has been treated with a humectant. In an embodiment where a humectant is used, the humectant includes glycerol, propylene glycol, or mixtures thereof. Furthermore, in an embodiment where a humectant is used, the humectant is present in the reconstituted plant material in an amount of 5% by weight or less, and/or the humectant is present in the reconstituted plant material in an amount of 5% by weight or greater, such as in an amount of about 10% by weight or greater, such as in an amount of about 15% by weight or greater, and in an amount of about 50% or less.

In an embodiment where the reconstituted plant material includes extracted cannabis fibers, the extracted cannabis fibers contain less than 0.3% by weight tetrahydrocannabinol.

In yet a further embodiment, the aerosol generating material includes an aerosol delivery composition applied to the reconstituted plant material, where the aerosol delivery composition contains an aerosol delivery agent. In an embodiment that includes an aerosol delivery composition, the aerosol delivery agent can include a drug or a flavorant. In a further embodiment, the aerosol delivery agent can include an oil or a solid, and in yet a further embodiment, the aerosol delivery agent includes nicotine, tetrahydrocannabinol, cannabidiol, or mixtures thereof. Additionally or alternatively, the aerosol delivery agent includes a sugar, a licorice extract, honey, a coffee extract, maple syrup, a tea extract, a botanical extract, a plant extract, a tobacco extract, or a fruit extract. In one aspect, the aerosol delivery agent can comprise one or more terpenes. A terpene or a blend of terpenes can be added to the reconstituted plant material in order to impart a distinct aroma that indicates a high quality cannabis product. Terpenes that can be added to the reconstituted plant material include pinene, humulene, b-caryophyllene, isopulegol, guaiol, nerylacetate, neomenthylacetate, limonene, menthone, dihydrojasmone, terpinolene, menthol, phellandrene, terpinene, geranylacetate, ocimene, myrcene, 1,4-cineole, 3-carene, linalool, menthofuran, perillyalcohol, pinane, neomenthylaceta, and substantial others.

In an embodiment that includes an aerosol delivery composition, the aerosol delivery composition is present on the reconstituted plant material in an amount greater than about 1% by weight, such as greater than about 3% by weight, such as greater than about 5% by weight, such as greater than about 10% by weight, such as greater than about 15% by weight, such as greater than about 20% by weight, such as greater than about 25% by weight, such as greater than about 30% by weight, such as greater than about 35% by weight, such as greater than about 40% by weight, and less than about 50% by weight.

In an embodiment according to the present disclosure, the reconstituted plant material has a basis weight of from about 40 gsm to about 120 gsm, such as from about 55 gsm to about 85 gsm.

Additionally or alternatively, in an embodiment of the present disclosure, the aerosol generating material is in the form of a filler material that includes a strip, strips, shreds, or mixtures thereof of the reconstituted plant material.

In general, the present disclosure also includes a smoking article. The smoking article includes an outer wrapper surrounding a smokeable rod, where the smokeable rod includes an aerosol generating material according to any of the above embodiments. In one embodiment, the wrapper includes a plurality of discrete reduced ignition areas being spaced along an axial direction of the smoking article, the reduced ignition areas having a diffusivity of less than about 0.5 cm/s at 23° C. In an embodiment that includes a plurality of reduced ignition areas, the plurality of reduced ignition areas have been formed by applying a reduced ignition composition to the wrapper. In a further embodiment, when the smoking article is tested according to ASTM Test E2187-09, at least 75% of the smoking articles self-extinguish.

In general, the present disclosure may also include a smoking article that includes a heating device and a chamber, the chamber containing the aerosol generating material as defined in any of the embodiments described above. The heating device is positioned so as to heat the aerosol generating material for producing an inhalable aerosol without burning the aerosol generating material.

Other features and aspects of the present disclosure are discussed in greater detail below.

BRIEF DESCRIPTION OF THE DRAWINGS

A full and enabling disclosure of the present disclosure is set forth more particularly in the remainder of the specification, including reference to the accompanying figures, in which.

Figure 1:
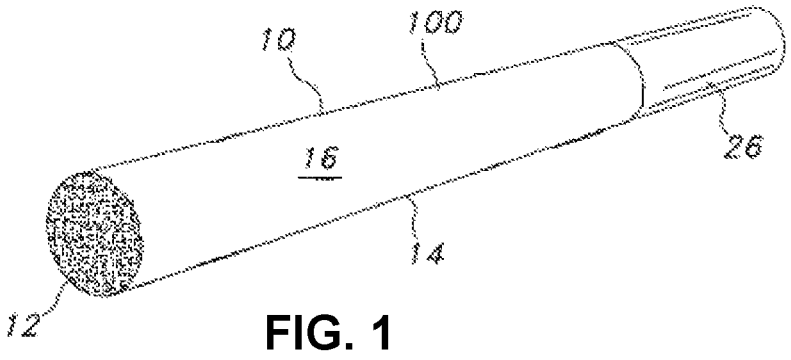
FIG. 1 is a perspective view of one embodiment of a smoking article incorporating the wrapper of the present disclosure.

Repeat use of reference characters in the present specification and drawings is intended to represent the same or analogous features or elements of the present invention.

Definitions

As used herein, a "reconstituted plant material" refers to a material formed by a process in which a plant feed stock, such as cocoa shells, tobacco or reconstituted tobacco, herbal plants, cannabis and/or hemp, for example, is extracted with a solvent to form an extract of solubles, such as water solubles, and an extracted insoluble portion or residue comprising fibrous material. The extracted and insoluble fibrous material is then formed into a sheet or web through any suitable process and the extract may either be discarded or reapplied to the formed sheet. The extract can be fed through various processes for concentrating the extract and optionally removing or adding various components prior to being recombined with the fibrous material. In the present disclosure, the reconstituted cocoa material is formed from extracted plant fiber fibers optionally combined with web building fibers, such as cellulose fibers. The extract of solubles obtained from the plant fiber fibers is optionally reapplied to the sheet.

As used herein, an "aerosol generating material" is meant to include both a combustible material that undergoes combustion in a smoking article and to an aerosol-forming material that is heated but not combusted to form an inhalable aerosol. Combustible smoking articles can include cigarettes, cigarillos and cigars. In a cigarette, the aerosol generating material is generally surrounded by a wrapping material to form a smokable rod, but may also be included in the wrapping material itself. Aerosol generating devices for generating an aerosol include, for instance, devices in which an aerosol is generated by electrical heating or by the transfer of heat from a combustible fuel element or heat source to heat but not burn the aerosol generating material, which releases volatile compounds. As the released compounds cool, they condense to form an aerosol that is inhaled by the consumer.

As used herein, "extracted plant fiber fibers" generally refers to plant fiber fibers that have been subjected to an extraction process in which the plant fiber has been contacted with an aqueous solution to remove water soluble components contained in the plant fibers. The extraction process is different from a delignification process and from a bleaching treatment.

As used herein, "extracted tobacco fibers" refers to tobacco fibers that have been subjected to an extraction process in which the tobacco components, such as stalks and hurds, and optionally, leaves, has been contacted with an aqueous solution to remove water soluble components contained in the tobacco components. The extraction process is different from a delignification process and from a bleaching treatment.

As used herein, "extracted herbal plant fibers" refers to herbal plant fibers that have been subjected to an extraction process in which the herbal plant fibers have been contacted with an aqueous solution to remove water soluble components contained in the herbal plant fibers. The extraction process is different from a delignification process and from a bleaching treatment.

As used herein, "extracted cannabis fibers" and/or "extracted hemp fibers" refers to cannabis fibers that have been subjected to an extraction process in which the cannabis has been contacted with an aqueous solution to remove water soluble components contained in the cannabis. The extraction process is different from a delignification process and from a bleaching treatment. As will be discussed in greater detail herein, it should be understood that the cannabis contacted for extraction may include cannabis that contains average or high levels of THC and/or CBD, hemp, which may contain low, or very low, levels of THC and/or CBD, industrial hemp, which may refer to a cannabis plant that contains less than 0.3% THC, or combinations thereof.

As used herein, "extracted byproducts" refers to cannabis biomass that has been subjected to an extraction process for removing selected components, such as cannabinoids, without removing a substantial amount of water soluble components. The extracted byproducts can be referred to as biomass resulting from an extraction process where the extractant is a solvent, such as ethanol, a supercritical fluid such as carbon dioxide, a lipid such as a vegetable oil, or the like. Extracted byproducts, in accordance with the present disclosure, can be subjected to a second extraction process for removing water soluble components during the process of making a reconstituted cannabis material. Extracted byproducts well suited for use in the present disclosure include those that contain water soluble components in an amount greater than about 8% by weight, such as in an amount greater than about 12% by weight, such as in an amount greater than about 18% by weight, such as in an amount greater than about 24% by weight.

As used herein, "cannabis" may refer to any variety of the *Cannabis* plant, such as *Cannabis sativa* or *Cannabis* indica, for instance. More particularly, the present disclosure may refer to leaves, stems, seeds and flowers or any other part of the *Cannabis* plant, as cannabis. Nonetheless, cannabis, as referred to herein, includes cannabis that contains average or high levels of THC and/or CBD (usually known as marijuana), hemp, which may contain low, or very low, levels of THC, industrial hemp, which may refer to a cannabis plant that contains less than 0.3% THC, or combinations thereof.

As used herein, "extracted cocoa fibers" and/or "extracted cocoa husk fibers" refers to cocoa or cocoa husk fibers that have been subjected to an extraction process in which the cocoa or cocoa husk has been contacted with an aqueous solution to remove water soluble components contained in the cocoa. The extraction process is different from a delignification process and from a bleaching treatment.

As used herein, "delignified" cellulosic fibers (e.g. pulp fibers) refers to fibers that have been subjected to a pulping or delignification process by which the cellulose fibers are separated from the plant material through chemical means, mechanical means, or through a combination of chemical and mechanical means.

As used herein, the term "refine" is used to mean that the plant material is subjected to a mechanical treatment that modifies the fibers of the material so that they are better suited to forming a fibrous sheet or substrate. Refining can be accomplished using a conical refiner, a disk refiner or a Valley beater. The mechanical process exerts an abrasive and bruising action on the plant material such that the plant material is deformed and declustered. Refining is a different process than delignification and pulping.

As used herein, the "amount of water soluble extracts" present in a substrate or reconstituted plant material or in an aerosol generating material is determined by placing 5 grams of a sample in boiling distilled water for 10 minutes to obtain an extract containing water soluble components. The weight of dry matter of the extract that is soluble in the solvent is calculated by the difference between the dry weight of the sample and the dry weight of the sample after extraction. The difference in dry weight is then used to determine the percentage of water soluble extracts in the sample.

As used herein, the term "stalk" is used to refer to the main structural portion of a plant that remains after the leaves have been removed.

As used herein, the term "hurd" is used herein to refer to the structural portion of a plant connecting the leaves or laminae to the stalk and also to the veins or ribs that extend through the leaves. The term "hurd" does not encompass the term "stalk" and vice versus.

DETAILED DESCRIPTION

It is to be understood by one of ordinary skill in the art that the present discussion is a description of exemplary embodiments only, and is not intended as limiting the broader aspects of the present disclosure.

The present disclosure is generally directed to an aerosol generating material that includes fibers, or aerosol generating materials, from two or more plant sources or materials. For instance, the present disclosure has unexpectedly found that a reconstituted plant material containing a mixture of at least two different plant fibers, or aerosol generating materials, may produce an aerosol generating material that maintains good sensory properties, such as a pleasant and/or natural taste, and may also control one or more active compounds contained within at least one of the plants from which the plant fibers and/or aerosol generating materials originated. For instance, in one embodiment, an amount of at least one of nicotine, THC, and CBD may be decreased as compared to a naturally occurring article, or may be eliminated from the aerosol generating material. However, the present disclosure has found that, by forming a reconstituted plant material using a blend of at least one of extracted cannabis fibers and extracted cocoa fibers in combination with at least one of extracted tobacco fibers, tobacco material, extracted herbal plant fibers, and aerosol generating herbal plant material, an aerosol generating material that maintains good sensory properties while controlling active compounds may be produced. For instance, the aerosol generating material according to the present disclosure may have a pleasant, neutral or natural taste or smell and can also regulate the amount of nicotine, THC, or CBD delivered to a user when the material is incorporated into an aerosol-producing article, such as a smoking article or a heat but not burn aerosol generating device.

In one embodiment, the aerosol generating material includes a reconstituted plant material containing a mixture of at least two different plant fibers, where one of the plant fibers includes at least one of extracted cannabis fibers and extracted cocoa fibers and another plant fiber includes at least one of extracted tobacco and extracted herbal plant fibers. Additionally or alternatively, the aerosol generating material may include a reconstituted plant material formed from at least one of extracted cannabis fibers and extracted plant fiber, and the reconstituted plant material may then be blended with at least one of an tobacco material and an herbal material. Regardless, the reconstituted plant material may, in one embodiment, be cut or shredded to form a loose filler material that is designed to generate an aerosol when heated or burned.

The reconstituted plant material of the present disclosure offers many advantages and benefits. For instance, the reconstituted material can be nicotine free, and/or low in THC (i.e. in an amount of about 0.3% or less), meaning that the material produces an aerosol when heated or burned that contains undetectable levels of nicotine and/or low to undetectable levels of THC. In addition, the reconstituted plant material can produce lower levels of tar than conventional tobacco fillers and may contain little to none of the cannabinoid and other compounds normally found in cannabis that contribute to bad taste and/or a harsh smoking experience. In addition, the reconstituted plant material has a very natural or neutral taste when combusted or heated, and may, in some embodiments, include a pleasant neutral and/or natural herbal taste. Mainstream smoke or an aerosol generated by the reconstituted plant material, for instance, produces a pleasant smoking or aerosol experience with an enjoyable and natural or neutral taste while being completely devoid of any harsh components.

Because the reconstituted plant material has a natural taste when smoked and can be nicotine free and/or low in THC, the reconstituted plant material can be used to produce a smoking article that is nicotine free and/or low in THC. In addition, the reconstituted material is well suited to being combined with other aerosol generating fillers and/or topical additives. For example, the reconstituted plant material can be combined with tobacco materials for forming an aerosol producing filler that has a tobacco taste that consumers desire while having reduced nicotine levels. For instance, the proportion of the reconstituted plant material of the present disclosure can be increased or decreased for controlling nicotine levels when combined with a tobacco material. When combined with a tobacco material, the reconstituted plant material of the present disclosure, due to its natural characteristics, does not in any way mask the taste of the tobacco materials and, in fact, can enhance the smoking or aerosol experience by diluting and decreasing irritants in addition to reducing nicotine levels.

I. Plant Fibers

As described above, the reconstituted plant material of the present disclosure is generally formed from extracted cannabis and/or extracted cocoa, and optionally, extracted tobacco and/or extracted herbal material.

Cannabis materials for use in the present disclosure include hurds, buds, flowers, seeds, and any by-products of cannabis extraction, such as cannabis residues, THC, and CBD, and optionally stalk components. In one embodiment, the cannabis components are obtained from cannabis plants that have a relatively low THC and/or CBD content. For instance, the amount of THC in the cannabis components can be less than about 1% by weight THC, such as less than about 0.3% by weight THC, such as less than about 0.2% by weight THC, such as less than about 0.1% by weight THC. Using cannabis components from low THC plants can offer various advantages and benefits. Producing a reconstituted cannabis material low in THC, for instance, allows for better control over THC deliveries when the THC is topically applied to the material. In addition, a reconstituted material can be produced that contains no detectable amounts of THC so that the material can deliver other active agents, such as CBD, flavorants, nicotine, or the like. It should be understood, however, that in other embodiments the reconstituted cannabis material can be made from high THC or CBD containing plants, such as from the species *Cannabis Indica* or *Cannabis Sativa*.

The reconstituted cannabis material of the present disclosure can be produced from various parts of the cannabis plant, including the hurds, leaves, buds, and flowers. These different parts of the plant can be combined in different ratios and amounts depending upon the particular application and the desired result. Although the reconstituted cannabis material can be made exclusively from cannabis leaves and hurds or can be made exclusively from cannabis buds and flowers, in one embodiment, the reconstituted material is made from a mixture of leaves and hurds combined with buds and/or flowers. For example, in one embodiment, the weight ratio between the leaves and hurds and the buds and/or flowers is from about 1:8 to about 8:1, such as from about 1:5 to about 5:1, such as from about 1:4 to about 4:1, such as from about 2:1 to about 1:2. In one embodiment, the ratio can be about 1:1.

In one embodiment, the reconstituted cannabis material may contain cannabis leaves and hurds in an amount greater than about 10% by weight, such as in an amount greater than about 20% by weight, such as in an amount greater than about 30% by weight, and generally in an amount less than about 70% by weight, such as in an amount less than about 60% by weight, such as in an amount less than about 50% by weight, such as in an amount less than about 40% by weight. Similarly, the reconstituted cannabis material may contain buds and/or flowers in an amount greater than about 10% by weight, such as in an amount greater than about 20% by weight, such as in an amount greater than about 30% by weight, such as in an amount greater than about 40% by weight, such as in an amount greater than about 50% by weight, such as in an amount greater than about 60% by weight, and generally in an amount less than about 80% by weight, such as in an amount less than about 70% by weight, such as in an amount less than about 60% by weight, such as in an amount less than about 50% by weight.

In one aspect, at least a portion of the cannabis components collected for producing the reconstituted cannabis material are cannabis extracted byproducts. Cannabis extracted byproducts include cannabis biomass that has already been subjected to a first extraction process for removing desired components from the plant, but without removing substantial amounts of the water soluble components. For example, the cannabis extracted byproducts can be the biomass that remains after one or more cannabinoids have been extracted from the cannabis plant material, such as THC and/or CBD. These types of extraction processes can use different solvents and supercritical fluids. For example, in one embodiment, the extracted byproducts result from a cannabis extraction process in which the cannabis material is ground and combined with a solvent. The solvent, for instance, can be an alcohol, such as ethanol, an organic ester, a petroleum derived hydrocarbon such as toluene or trimethylpentane, or a lipid, such as a vegetable oil. Examples of vegetable oils include safflower oil, coconut oil, and the like. In an alternative embodiment, during the extraction process, the cannabis plant material can be contacted with a supercritical fluid, such as carbon dioxide. In general, the extraction process includes grinding or cutting the plant material to a desired size and then contacting the material with an extractant, such as a solvent or a supercritical fluid. The material can be heated during contact with the solvent. When contacted with a supercritical fluid, for instance, the temperature can be from about 31° C. to about 80° C. and the pressure can be from about 75 bar to about 500 bar.

Using extracted byproducts as a portion of the cannabis components can provide various advantages. For instance, the cannabis extracted byproducts may produce a more mild aerosol and may be in a form that is easier to handle than the virgin plant materials. In order to produce a reconstituted cannabis material, the cannabis extracted byproducts can undergo a second extraction process for removing the water soluble components. The cannabis extracted byproducts, for instance, may contain water soluble components in an amount greater than about 8% by weight, such as in an amount greater than about 12% by weight, such as in an amount greater than about 18% by weight, such as in an amount greater than about 24% by weight, such as in an amount greater than about 28% by weight, and generally in an amount less than about 60% by weight, such as in an amount less than about 50% by weight.

Cocoa materials for use in the present disclosure are obtained from *Theobroma cacao*, which is also referred to as the cacao tree. The cacao tree is in the evergreen family and is native to tropical regions. The cacao tree produces a fruit, referred to as a cacao pod. Cacao pods are generally yellow to orange in color and can weigh over one pound when ripe. The pod contains anywhere from 10 to about 80 cocoa beans that are used to produce chocolate, juices, jelly, and the like. After the beans are removed from the cacao pod, the cocoa beans are dried and cured or fermented by being exposed to sunlight and/or ultraviolet light. Each individual bean is covered in a husk or shell. The husk or shell is removed from the bean prior to using the bean for producing food products. The reconstituted plant material of the present disclosure is made from the cocoa shells or husks, although other components of the cacao pod may also be used.

Tobacco materials for use in the present disclosure may include for instance, cut leaf tobacco, a reconstituted tobacco material, or mixtures thereof, and include tobacco hurds, stalks, and optionally leaves, as well as scraps.

Herbal plant materials for use in the present disclosure botanical plants, and trees, including herbs, plants and trees that may be used to form smokable fibers or herbal smokeable articles, such as cocoa tree, coffee tree or coffee bean, tea tree or tea leaf, vine, ginger, ginkgo, chamomile, tomato, ivy, mate, rooibos, cucumber, mint, a cereal such as wheat, barley or rye, or other trees such as broadleaved or resinous trees, and the like, as well as combinations thereof II. Method of Forming Filler Materials The cannabis, tobacco, cocoa shells, and herbal plants contain plant fibers which, when formed according to the present disclosure, are well suited to forming substrates and web materials. In one embodiment, the plant fibers from at least one of the cannabis, tobacco, cocoa shells, and herbal plants are optionally sized or ground and then subjected to an extraction process for removing water soluble components. The extracted plant fibers can then be combined with web building fibers and formed into a substrate, such as a reconstituted sheet. The substrate can optionally be treated with the soluble extract obtained from the plant fibers. Alternatively, the extract obtained from the plant fibers can be discarded and not recombined with the water insoluble fibers and other materials. The reconstituted material is then dried and formed into an aerosol generating material, such as an aerosol generating filler. The aerosol generating material can then optionally be combined with various other components. For instance, the material can be treated with various aerosol delivery agents and/or combined with various other aerosol or smoking fillers, such as tobacco materials or other herbal fillers.

The resulting aerosol generating material made in accordance with the present disclosure can then be used in numerous different types of consumer products. For instance, in one embodiment, the aerosol generating material can be incorporated into smoking articles, such as cigarettes, cigarillos, cigars, and the like. In one embodiment, the aerosol generating material of the present disclosure can be packaged and sold as a loose filler material for use in pipes or to allow consumers to roll their own cigarettes or other smoking articles. In an alternative embodiment, the aerosol generating material of the present disclosure can be incorporated into devices that heat the material without burning the material to produce an aerosol that is inhaled. The aerosol generating material can be cut, shredded, or otherwise processed into a form best suited for the particular application and product.

In forming the reconstituted plant material of the present disclosure, plant fibers from at least one of the cannabis, tobacco, cocoa shells, and herbal plants are first collected and optionally reduced in size. For example, in one embodiment, the plant fibers can be subjected to a grinding operation, milling operation or beating operation that can reduce the size of the plant fibers and/or reduce the plant fibers into individual fibers. For example, in one embodiment, the plant fibers can be fed to a hammer mill that beats the plant fibers against a screen for producing a fibrous material.

After the plant fiber(s) are optionally reduced in size, the plant fiber(s) are subjected to an extraction process for removing water soluble components. The extraction process can provide various different benefits. For instance, the extraction process can remove from the plant fiber pectin which makes it easier to process the plant fiber into a fiber substrate or a reconstituted plant sheet. It is believed that removing the pectin from the plant fiber also contributes to the neutral taste of the final product.

Subjecting the plant fiber to an extraction process also cleans the plant fibers and removes any herbicides or pesticides and micro-organisms that may be present on the material.

During the extraction process, the plant fiber(s) are contacted with a solvent in order to remove the water soluble components. In one embodiment, the solvent comprises only water. In an alternative embodiment, various solvents that are water-miscible, such as alcohols (e.g., ethanol) and/or suitable oils and fats, can be combined with water to form an aqueous solvent. For example, suitable oils and fats may be those in which THC and/or CBD are soluble, in order to extract THC and/or CBD from the plant fibers during the extraction phase. The water content of the aqueous solvent can, in some instances, be greater than 50 wt. % of the solvent, and particularly greater than 90 wt. % of the solvent. Deionized water, distilled water or tap water may be employed. The amount of the solvent in the suspension can vary widely, but is generally added in an amount from about 50% to w/w about 99% w/w, in some embodiments from about 60% w/w to about 95% w/w, and in some embodiments, from about 75% w/w to about 91% w/w of the suspension. However, the amount of solvent can vary with the nature of the solvent, the temperature at which the extraction is to be carried out, and the type of plant furnish.

After forming the solvent/plant fiber mixture, some or all of a soluble fraction of the mixture may be separated from the insoluble portion of the mixture. The solvent/plant fiber mixture can be agitated by stirring, shaking or otherwise mixing the mixture in order to increase the rate of solubilization. Typically, the process is carried out for about one-half hour to about 6 hours. Process temperatures may range from about 10° C. to about 100° C., such as from about 40° C. to about 90° C.

After the plant fibers are soaked in an extractant, the insoluble plant fiber material can be mechanically separated from the soluble plant fiber mixture located in the extract using a press. Once the soluble fraction is separated from the insoluble fraction, the soluble fraction can be discarded or further processed, such as by being concentrated. The soluble fraction can be concentrated using any known type of concentrator, such as a vacuum evaporator. In one embodiment of the present disclosure, the soluble fraction can be highly concentrated. In one embodiment, for instance, the soluble fraction can be evaporated so as to have a final brix of from about 5% to about 70%, such as from about 15% to about 60%.

The resulting concentrated soluble fraction may be used in a separate process, or can be later coated onto the reconstituted plant material of the present disclosure as will be described in greater detail below.

The resulting water insoluble fraction is generally in an unrefined state and contains particles and fibers. In one embodiment, the insoluble portion can be subjected to a refining process. For instance, the extracted insoluble plant fiber material can be fed through any suitable refining device, such as a conical refiner or a disk refiner. Other refining devices that may be used include a beater, such as a Valley beater, a conical refiner or disks refiner. Refining can occur while the cocoa materials are moist or after being combined with water. For instance, in one embodiment, refining can occur while the plant fiber material is at a consistency of less than about 10%, such as less than about 5%, such as less than about 3%.

In accordance with the present disclosure, the extracted plant fiber material may optionally be combined with web building fibers in forming a fiber substrate, such as a reconstituted plant material. For example, the extracted plant fiber can be combined with water or an aqueous solution to form a slurry, or alternatively the extracted fiber may be combined in a solution to form a slurry without the incorporation of web building fibers. In some embodiments, the web building fibers may increase the tensile strength of the sheet of reconstituted plant material. When web building fibers are used, the web building fibers, such as delignified cellulosic fibers, can be combined with the plant fiber material in forming the slurry. Regardless of whether web building fibers are used, fiber slurry is then used to form a continuous reconstituted sheet. For example, in one embodiment, the fiber slurry is fed to a papermaking process that can include a forming wire, gravity drain, suction drain, a felt press, and a dryer, such as a Yankee dryer, a drum dryer, or the like. For example, in one embodiment, the fiber slurry is formed into a continuous sheet on a Fourdrinier table. One advantage to combining the extracted plant fiber with the cellulosic fibers is that the resulting fiber furnish may be more easily processed on conventional papermaking equipment, however, it should be noted that, reconstituted plant material according to the present disclosure may be, in some embodiments, well suited for use with papermaking equipment without the addition of web building fibers.

In one embodiment, the fiber slurry is laid onto a porous forming surface and formed into a sheet. Excess water is removed by a gravity drain and/or a suction drain. In addition, various presses can be used to facilitate water removal. The formed sheet can be dried and further treated.

Reconstituted plant material substrates can also be made using various other different methods. For example, in one embodiment, the extracted plant fibers and optionally, web building fibers, may be extruded into a reconstituted material. In one embodiment, the reconstituted material can also be subjected to an expansion process. Expanded sheets can be made using, for instance, a gas, such as carbon dioxide, or by using a foaming agent. Suitable expansion mediums include starch, pullulan or other polysaccharides, solid foaming agents, inorganic salts and organic acids that provide in situ gaseous components, organic gaseous agents, inorganic gaseous agents, and volatile liquid foaming agents. Extruding also allows for the formation of rods or strands in addition to sheet materials.

In one aspect, the reconstituted plant material can be formed according to a cast leaf process. In a cast leaf process, the plant material is shredded and then blended with other materials, such as a binder, and formed into a slurry. Web building fibers can be contained within the slurry. To form a web of material, the slurry is transferred to a sheet forming apparatus. The sheet forming apparatus can be a continuous belt where the slurry may be continuously spread onto the belt. The slurry is distributed on the surface to form a sheet. The sheet is then dried, such as by using heat. The sheet can be wound onto a bobbin, trimmed, slitted or otherwise manipulated for forming products.

While, thus far, the formation of the aerosol generating material has been described by first extracting and refining the plant materials and then mixing with other fibers, it should be understood that one or more types of plant fibers, may be mixed during the extraction stage, such that the plant fibers undergo extraction and refining at the same time. Of course, as discussed above, each individual plant may be extracted separately, and then mixed with the other plant fibers during the pulping/refining process.

Regardless of the aerosol generating composition formed, optionally, the aerosol generating composition that is produced can also be treated with the soluble portion of the plant fiber(s), such as a concentrated soluble portion that was separated from the insoluble fraction. The soluble portion can be applied to the web using various application methods, such as spraying, using a size press, saturating, etc. The amount of water soluble extracts applied to the reconstituted material can depend upon various factors and the anticipated end use application. In general, the water soluble extracts can be applied to the reconstituted plant material in an amount insufficient to adversely interfere with the neutral taste of the underlying material. For instance, in one embodiment, the water soluble extracts are applied to the reconstituted material such that the reconstituted material contains water soluble extracts in an amount up to about 40% by weight, such as in an amount less than about 30% by weight, such as in an amount less than about 20% by weight, such as in an amount less than about 10% by weight, such as in an amount less than about 5% by weight, such as in an amount less than about 1% by weight and generally in an amount greater than about 0.5% by weight.

III. Filler Blend

Regardless of the method used, reconstituted plant material according to the present disclosure may, in one embodiment, contain a mixture of at least two plant fibers, where at least one of the plant fibers is selected from extracted cannabis fibers (which, as discussed above may include cannabis leaves, cannabis hurds, cannabis buds, cannabis flowers, cannabis seeds, any by-products of cannabis extraction, or mixtures thereof), or extracted cocoa husk fibers and at least one plant fiber selected from extracted tobacco (which, as discussed above, may include tobacco leaves, tobacco hurds, any by-products of tobacco extraction, or mixtures thereof) or extracted herbal fibers. Of course, in one embodiment, the reconstituted plant material may include both cannabis fibers and cocoa husk fibers, in addition to the fibers selected from extracted tobacco or extracted herbal fibers, or alternatively, may contain both extracted tobacco and extracted herbal plant fibers in combination with one of cannabis fibers or extracted cocoa husk fibers. In yet a further embodiment, the reconstituted plant material may include extracted cannabis fibers, extracted cannabis leaves, extracted tobacco fibers and extracted herbal fibers. Particularly, the present disclosure has found that the above blends of extracted fibers yield reconstituted plant materials that are well suited as aerosol generating materials, as they yield a pleasant, natural taste and smell and are not "papery", have good burn qualities, are free from undesired active compounds, and also serve as excellent carriers for aerosol generating fillers and topical additives.

For instance, in a further embodiment, the reconstituted plant material may be formed from at least one of extracted cannabis fibers or extracted cocoa husk fibers, or mixtures thereof, and the reconstituted plant material may be blended with at least one of a tobacco material or a herbal material. The tobacco material or herbal material may be blended with the reconstituted material as an aerosol generating filler. For instance, the tobacco material and/or the herbal material may, individually or together, be formed into a second reconstituted plant material as described above, and mixed with the first reconstituted plant material (containing at least one of cannabis fibers and extracted cocoa husk fibers) as an aerosol generating filler. In such an embodiment, the filler may contain discrete and/or loose pieces of both the first reconstituted plant material and the second reconstituted plant material, or the first reconstituted plant material and the second reconstituted plant material may be refined or re-refined together in order to form a single reconstituted plant material containing fibers from both the first reconstituted plant material and the second reconstituted plant material, and then processed as described above to form the aerosol generating material.

Regardless of the method selected of blending the tobacco material and/or the herbal material with the reconstituted plant material, in one embodiment, the reconstituted plant material may include both cannabis fibers and extracted cocoa husk fibers, and may be blended with at least one of an tobacco material and an herbal material, or may be blended with both an tobacco material and an herbal material. Alternatively, the reconstituted plant material include only one of cannabis fibers and extracted cocoa husk fibers, blended with at least one of an tobacco material and an herbal material, or may be blended with both an tobacco material and an herbal material. Regardless of the manner in which the tobacco material or herbal material are blended with the reconstituted plant material, the present disclosure has found that the above reconstituted plant material and aerosol generating tobacco or herbal materials yield reconstituted plant materials that are well suited as aerosol generating materials, as they yield a pleasant, natural taste and smell and are not "papery", have good burn qualities, are free from undesired active compounds, and also serve as excellent carriers for aerosol generating fillers and topical additives.

For instance, as discussed above, the present disclosure has found that cocoa husk and extracted cannabis fibers, yield a pleasant, neutral or natural taste and smell, and may serve as an excellent base for other components, such as tobacco and/or extracted herbal plant fibers, as the sensory components of cocoa fibers and extracted cannabis fibers provide, respectively, neutral and natural bases for other sensory components while maintaining good burn properties. Furthermore, cocoa and cannabis fibers are also free from nicotine, and may be refined to be low in, or free from other active or harsh compounds. Similarly, tobacco and/or herbal plant fibers may be used to form any number of unique aerosol generating materials that have a wide variety of tastes and smells. Therefore, the present disclosure has found that unique blends may be formed according to the present disclosure that result in a variety of aerosol generating compounds that have a neutral or natural taste and smell, good burn properties, and that are low in active compounds and/or harsh compounds.

As described above, the reconstituted plant material of the present disclosure generally contains extracted plant fibers from one or more of cannabis, tobacco, cocoa shells, and herbal plants, optionally, in combination with web building fibers. The web building fibers may be incorporated into the reconstituted plant material or fiber substrate in an amount sufficient to provide strength and integrity to the resulting material when used. Web building fibers can also be incorporated into the reconstituted plant material so as to trap and prevent plant fibers and other plant components from separating from the fiber substrate.

Various different types of web building fibers may optionally be used in the reconstituted plant material. Of course, it should be understood that in one embodiment, no web building fibers are present in the reconstituted plant product or aerosol generating composition, as, in some embodiments, the reconstituted tobacco and/or herbal plant fibers, or fibers from other plants, may form a reconstituted plant material with good or sufficient strength properties. However, in an embodiment where web building fibers are used, the web building fibers may be delignified cellulosic fibers. For instance, the web building fibers may comprise wood pulp fibers such as softwood fibers or hardwood fibers. Other cellulosic fibers that may be used include flax fibers, hemp fibers, abaca fibers, bamboo fibers, coconut fibers, cotton fibers, kapok fibers, ramie fibers, jute fibers, or mixtures thereof. In one particular embodiment, the web building fibers contain softwood fibers alone or in combination with other fibers such as hardwood fibers, abaca fibers, or the like.

In one embodiment, the web building fibers can be hemp pulp fibers. The hemp pulp fibers can have an average fiber length of generally greater than about 0.5 mm, such as greater than about 1 mm, such as greater than about 1.5 mm, such as greater than about 1.8 mm, and generally less than about 4 mm, such as less than about 3 mm, such as less than about 2.5 mm, such as less than about 2.35 mm.

In general, when used, the web building fibers are present in the reconstituted plant material in an amount greater than about 5% by weight, such as in an amount greater than about 10% by weight, such as in an amount greater than about 15% by weight, such as in an amount greater than about 20% by weight, such as in an amount greater than about 25% by weight, such as in an amount greater than about 30% by weight, such as in an amount greater than about 40% by weight. The web building fibers are generally present in the reconstituted plant material in an amount less than about 55% by weight, such as in an amount less than about 50% by weight, such as in an amount less than about 45% by weight, such as in an amount less than about 30% by weight, such as in an amount less than about 25% by weight, or any ranges therebetween.

In one embodiment, the web building fibers incorporated into the reconstituted plant material include a combination of longer fibers and shorter fibers. The longer fibers can generally have an average length of greater than about 1.8 mm, such as greater than about 2 mm, while the shorter fibers can generally have an average length of less than about 1.5 mm. The longer fibers can be used to improve strength and integrity, while the shorter fibers can better retain the cocoa fibers and other components within the fiber substrate. In one embodiment, for instance, the short fibers may be present in the reconstituted plant material in an amount greater than about 5% by weight, such as in an amount greater than about 10% by weight, and generally in an amount less than about 20% by weight. The longer fibers, on the other hand, can be present in the reconstituted web material in an amount greater than about 10% by weight, such as in an amount greater than about 20% by weight, and generally in an amount less than about 50% by weight, such as in an amount less than about 40% by weight. In one embodiment, the shorter fibers comprise hardwood fibers, while the longer fibers comprise softwood fibers.

In one embodiment, the reconstituted web material can further contain a humectant. The humectant can be incorporated into the reconstituted plant material for various different reasons in order to provide different benefits and advantages. For instance, in one embodiment, a humectant may be incorporated into the reconstituted plant material in order to improve the processability and handling of the resulting fiber substrate. In an alternative embodiment, a humectant can be added to the reconstituted plant material in greater amounts so that the material is well suited for use in applications where the material is heated but not burned in order to produce an inhalable aerosol.

Various different humectants can be incorporated into the reconstituted plant material. The humectant, for instance, may comprise glycerol, propylene glycol, or mixtures thereof. Other humectants that may be used include sorbitol, triethylene glycol, lactic acid, glyceryl diacetate, glyceryl triacetate, triethyl citrate, isopropyl myristate, and mixtures thereof including mixtures with glycerol and/or propylene glycol.

As described above, the amount of humectant applied to the reconstituted plant material can depend upon various factors. In one embodiment, for instance, the humectant is present on the reconstituted plant material in an amount less than about 5% by weight, such as in an amount less than about 3% by weight, and generally in an amount greater than about 0.5% by weight, such as in an amount greater than about 1% by weight. In other embodiments, the humectant may be present on the plant material in an amount greater than about 5% by weight, such as in an amount greater than about 10% by weight, such as in an amount greater than about 15% by weight, such as in an amount greater than about 20% by weight, and generally in an amount less than about 50% by weight, such as in an amount less than about 40% by weight, such as in an amount less than about 30% by weight, such as in an amount less than about 25% by weight. When added to the reconstituted plant material in an amount from about 10 to 40% by weight, such as in an amount from about 12 to about 30% by weight, such as in an amount from about 15 to about 25% by weight, the humectant serves as an aerosol generating agent that facilitates formation of an aerosol when the reconstituted plant material is heated without being combusted.

The reconstituted plant material of the present disclosure can also contain various other optional components. For example, in one embodiment, the reconstituted plant material can optionally be treated with a burn control agent. The burn control agent can control the burn rate of the material and/or can serve as an ash conditioner for improving the coherency and/or color of the ash that is produced when the material is combusted.

The burn control agent, for instance, may comprise a salt of a carboxylic acid. For example, the burn control agent may comprise an alkali metal salt of a carboxylic acid, an alkaline earth metal salt of a carboxylic acid, or mixtures thereof. Examples of burn control agents that may be used include a salt of acetic acid, citric acid, malic acid, lactic acid, tartaric acid, carbonic acid, formic acid, propionic acid, glycolic acid, fumaric acid, oxalic acid, malonic acid, succinic acid, nitric acid, phosphoric acid, or mixtures thereof. Particular burn controlling agents that may be used include potassium citrate, sodium citrate, potassium succinate, sodium succinate, or mixtures thereof. When present, the burn control agent can be applied to the reconstituted plant material generally in an amount greater than about 0.1% by weight, such as in an amount greater than about 0.5% by weight, such as in an amount greater than about 1% by weight and generally less than about 5% by weight, such as less than about 4% by weight, such as less than about 3% by weight, such as less than about 2% by weight.

The reconstituted plant material of the present disclosure may also optionally contain a filler. The filler can comprise particles incorporated into the reconstituted web material for any desired purpose, such as for facilitating formation of the reconstituted plant material and/or for affecting the appearance of the material. Filler particles that may be incorporated into the reconstituted web material can be made from calcium carbonate, magnesium oxide, titanium dioxide, kaolin clay, barium sulfate, a silicate, bentonite, mica, or mixtures thereof. Filler particles can optionally be incorporated into the reconstituted web material in an amount greater than about 1% by weight, such as in an amount greater than about 5% by weight, such as in an amount greater than about 10% by weight, and generally in an amount less than about 30% by weight, such as in an amount less than about 25% by weight, such as in an amount less than about 20% by weight, such as in an amount less than about 15% by weight.

Once the reconstituted plant material has been formed into a fibrous substrate as described above, the material can be used as an aerosol generating material for use in any suitable smoking article or in a device that heats but does not combust the material. In one embodiment, the reconstituted plant material can first be formed into a loose filler material by being fed through a shredding or cutting process. For instance, the loose filler material can be in the forms of a strip, strips, shreds, or mixtures thereof. The loose filler material can then be packed into any suitable aerosol generating device or smoking article.

Figure 2:
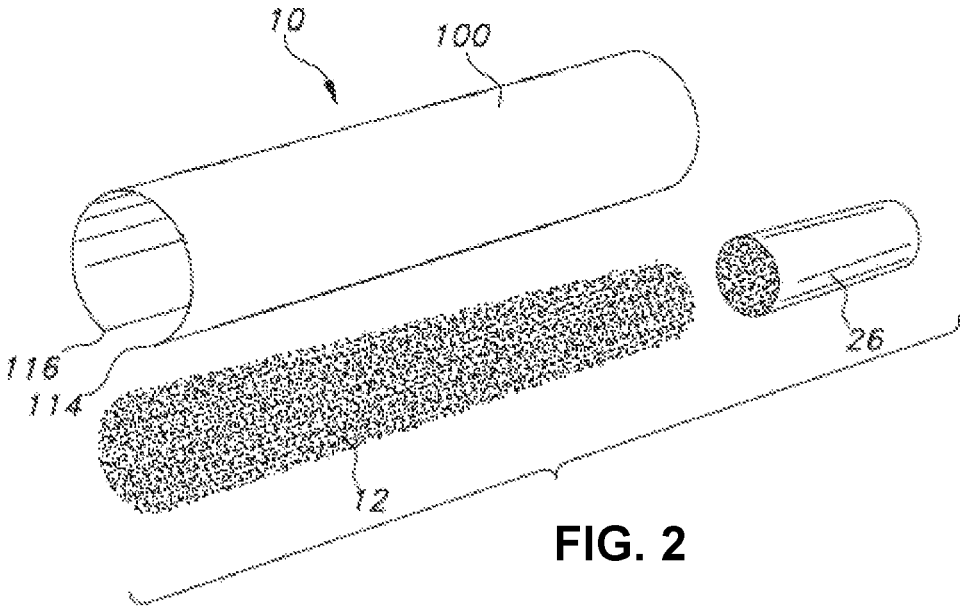
FIG. 2 is an exploded view of the smoking article illustrated in FIG. 1.

For instance, the smoking article shown in FIGS. 1 and 2 generally comprises a cigarette that may contain any filler discussed herein as all or part of the smokeable column 12. For illustrative purposes only, one such smoking article is shown in FIGS. 1 and 2. As shown, the smoking article 10 includes a smokable column 12. The smoking article 10 may also include a wrapping material 100 that defines an outer circumferential surface 16 when wrapped around the smokable column 12. The article 10 may also include a filter 26 that may be enclosed by a tipping paper, however, depending upon the smokable column material, a filter may be optional or omitted.

The reconstituted plant material of the present disclosure produces an aerosol or smoke that has a very neutral and pleasing taste. An aerosol generated by the material has no harsh components. Of particular advantage, the reconstituted plant material of the present disclosure is nicotine free and thus can be used to produce a nicotine-free smoking article or a nicotine-free aerosol generating product or can be used to control nicotine delivery in the above products.

IV. Additives

In one embodiment, for instance, the reconstituted plant material of the present disclosure can be combined with tobacco during the production of the reconstituted plant material to form an aerosol generating material that produces an aerosol or smoke with a controlled amount nicotine in comparison to an aerosol generated by the tobacco material by itself. For example, the reconstituted plant material of the present disclosure can be combined with any suitable tobacco material in an amount sufficient to produce an aerosol that contains a controlled amount of nicotine or tobacco flavoring. For instance, in one embodiment, the reconstituted plant material may contain a low amount of nicotine, particularly as compared to a natural tobacco product, and may contain about 0.5% or less nicotine by weight of the reconstituted plant material. Alternatively, a reconstituted plant material may be formed that contains a "high" amount of nicotine as compared to the low nicotine embodiment described above, such that the reconstituted plant material contains greater than about 0.5% nicotine by weight of the reconstituted plant material.

As discussed above, in one embodiment, the reconstituted plant material of the present disclosure can be in the form of a loose filler material that is homogenously blended with a tobacco material or a herbal plant material for forming an aerosol generating material with reduced nicotine deliveries and a desirable taste and smell. The aerosol generating material, for instance, may contain the reconstituted plant material of the present disclosure in an amount greater than about 5% by weight, such as in an amount greater than about 10% by weight, such as in an amount greater than about 20% by weight, such as in an amount greater than about 30% by weight, such as in an amount greater than about 40% by weight, such as in an amount greater than about 50% by weight, such as in an amount greater than about 60% by weight, such as in an amount greater than about 70% by weight, such as in an amount greater than about 80% by weight. The reconstituted plant material of the present disclosure can be combined with a tobacco material such that the resulting aerosol generating material may contain the reconstituted plant material in an amount less than about 90% by weight, such as in an amount less than about 80% by weight, such as in an amount less than about 70% by weight, such as in an amount less than about 60% by weight, such as in an amount less than about 50% by weight, such as in an amount less than about 40% by weight, such as in an amount less than about 30% by weight. For example, in one embodiment, the aerosol generating material may contain the reconstituted plant material of the present disclosure in an amount from about 5% to about 30% by weight, such as in an amount from about 10% to about 20% by weight. In an alternative embodiment, greater amounts of the reconstituted plant material may be incorporated into the aerosol generating material. In this embodiment, the reconstituted plant material may be contained in the aerosol generating material in an amount from about 30% to about 80% by weight, such as in an amount from about 40% to about 60% by weight. The above weight percentages are based upon the total weight of the aerosol generating material. In one embodiment, remaining portion of the aerosol generating material can be supplied exclusively by a tobacco filler or a herbal plant filler.

In still another embodiment, the reconstituted plant material of the present disclosure, instead of being combined with a tobacco material or a herbal plant material, or in addition to being combined with a tobacco material and/or a herbal plant material, may be treated with an aerosol delivery composition containing nicotine, other active compounds, such as THC, or flavoring, including topical additives. The aerosol delivery composition, for instance, can be topically applied to the reconstituted plant material for incorporating into the material controlled amounts of nicotine other active compounds, or flavoring. Applying nicotine, other active compounds, or flavoring to the reconstituted plant material can provide numerous benefits and advantages. For example, applying nicotine, other active compounds, or flavoring to the reconstituted plant material allows for precise amounts of nicotine, other active compounds, or flavoring delivery when the reconstituted plant material is converted into an aerosol and inhaled. In addition, the nicotine, other active compounds, or flavoring can be applied to the reconstituted plant material in a manner such that the amount of compound contained in an aerosol generated by the material is uniform and consistent from puff to puff. Consequently, in one embodiment, the reconstituted plant material of the present disclosure can be used to produce an aerosol generating material that is neutral and pleasant in taste while still delivering controlled amounts, such as low amounts of nicotine, other active compounds, or flavoring.

For example, in one embodiment, the aerosol delivery composition applied to the reconstituted plant material can contain a low amount of nicotine, particularly as compared to a natural tobacco product, and may contain about 0.5% or less nicotine by weight of the reconstituted plant material. Alternatively, a reconstituted plant material may be formed that contains a "high" amount of nicotine as compared to the low nicotine embodiment described above, such that the reconstituted plant material contains greater than about 0.5% nicotine by weight of the reconstituted plant material. Additionally or alternatively, a tobacco material that may have all or a portion of the nicotine extracted therefrom can be used to produce a tobacco taste and smell while nicotine can be applied separately to the wrapping material in the form of an aerosol delivery composition for better controlling nicotine levels. In this embodiment, the amount of tobacco material in the aerosol generating material can be less than about 50% by weight, such as less than about 40% by weight, such as less than about 30% by weight, such as less than about 20% by weight, such as less than about 10% by weight, and generally greater than about 2% by weight.

In addition to being combined with tobacco materials and/or herbal plant materials, it should be understood that the reconstituted plant material of the present disclosure can be combined with any suitable aerosol generating filler.

In addition to nicotine, the reconstituted plant material of the present disclosure is well suited to receiving other aerosol delivery agents. The reconstituted plant material, for instance, is highly absorbable and can contain up to 50% by weight of topical additives. In this regard, the reconstituted plant material of the present disclosure is also well suited to acting as a carrier for various different aerosol delivery compositions. Each aerosol delivery composition, for instance, can contain one or more aerosol delivery agents.

Aerosol delivery compositions that can be applied to the reconstituted plant material of the present disclosure include solutions, suspensions, oils, and the like. Solutions and suspensions, for instance, can be applied to the reconstituted plant material and later dried leaving behind a solid residue within the fiber substrate.

In one embodiment, an aerosol delivery composition may be obtained by extracting a plant substance from a plant for application to the reconstituted plant material. Additionally or alternatively, the present disclosure may include a step for isolating at least one compound from a plant substance, concentrating a plant substance, or even a purifying or eliminating a compound from a plant substance, in order to obtain a modified plant substance to be applied to the aerosol generating material. While optional, such a process may result in the transformation of an original raw plant substance into a modified plant substance, whether in the form of dry extracts, liquid extract, a liquor or an isolated substance, based upon the desired end properties of the plant substance to be applied to the aerosol generating material. Of course, while the plant substance may be an original plant substance or a modified plant substance, in one embodiment, the plant substance is applied to the reconstituted plant material without undergoing any further processing after extraction. Furthermore, while the aerosol delivery composition has been described as being extracted from a plant, it should be understood that synthetic or naturally occurring aerosol delivery compositions (e.g. without needing to be extracted) may also be used.

Examples of aerosol delivery agents that may be contained in the aerosol delivery composition include, or may be an extract of, (in addition to nicotine) sugars, licorice extracts, menthol, honey, coffee, maple syrup, tobacco, botanical extracts, plant extracts, tea, fruit extracts, flavorings such as clove, anise, cinnamon, sandalwood, geranium, rose oil, vanilla, caramel, cocoa, lemon oil, cassia, spearmint, fennel, or ginger, fragrances or aromas such as cocoa, vanilla, and caramel, medicinal plants, vegetables, spices, roots, berries, bar, seeks, essential oils and extracts thereof, such as anise oil, clove oil, carvone and the like, artificial flavoring and fragrance materials such as vanillin, and mixtures thereof. The extracts applied to the reconstituted plant material can be water soluble or oil soluble. Thus, various different carrier liquids can be used to apply the aerosol delivery agents to the reconstituted plant material.

In one embodiment, the reconstituted plant material of the present disclosure can be used as a carrier for components obtained from cannabis. Cannabis, for instance, has recently been legalized in Canada and in many states in the United States for both medical and recreational use. Various chemicals and compounds contained in cannabis are becoming more and more popular drugs for pain relief in lieu of conventional pain relief medicines, such as opioids. Cannabis, for instance, contains various cannabinoids that can be used for pain relief. Inhaling an aerosol created by cannabis is the most common and least expensive method for delivering drugs contained in cannabis to a user. Unfortunately, however, merely inhaling aerosol generated from dried cannabis buds or leaves can lead to non-uniform deliveries of the pain relief drugs contained in the plant. Deliveries of the cannabinoids, for instance, can vary dramatically depending upon the particular plant and the particular plant parts being used to generate the aerosol. In addition, cannabinoid deliveries can vary dramatically based upon other factors such as the packing density of the material, the particular type of aerosol generating device or smoking article used to produce an aerosol, and the like. In addition, aerosols created from cannabis plant can contain irritants and produce a relatively harsh aerosol or smoke. The reconstituted plant material of the present disclosure, however, can be used to deliver cannabinoids in an aerosol generated from the material without any of the above drawbacks and deficiencies. For instance, the aerosol generated from the reconstituted plant material of the present disclosure is non-irritating, does not contain harsh components, and has a neutral taste. In addition, applying cannabinoids topically to the reconstituted plant material allows for uniform and consistent deliveries of the cannabinoids when contained in an aerosol generated by the reconstituted plant material and inhaled.

Cannabinoids that can be incorporated into the reconstituted plant material of the present disclosure include cannabidiol (CBD) and tetrahydrocannabinol (THC). THC contained in cannabis acts on specific receptors in the brain which lead to a feeling of euphoria and a relaxed state. CBD, on the other hand, also interacts with pain receptors in the brain but does not create the same euphoric feeling caused by THC. In accordance with the present disclosure, in one embodiment, THC can be applied to the reconstituted plant material of the present disclosure, CBD can be applied to the reconstituted plant material or, alternatively, both THC and CBD can be applied to the reconstituted plant material.

In addition to THC and CBD, various other cannabinoids can also be incorporated into an aerosol delivery composition and applied to the reconstituted plant material in accordance with the present disclosure. For instance, other cannabinoids contained in cannabis include cannabichromene, cannabinol, cannabigerol, tetrahydrocannabivarin, cannabidivarin, cannabidiolic acid, other cannabidiol derivatives, and other tetrahydrocannabinol derivatives. The above cannabinoids can be used singularly or in any combination and applied to the reconstituted plant material.

The cannabinoids described above can be applied to the reconstituted plant material using various different methods. For instance, in one embodiment, the cannabinoid, such as CBD, can be formulated into a water soluble form or powder that can be applied to the reconstituted plant material as a solution or aqueous suspension. Alternatively, a cannabis oil extract may be obtained from raw cannabis plants. The oil extract may contain THC alone, CBD alone, or a combination of THC and CBD. The oil extract can be applied to the reconstituted plant material so that an aerosol generated by the material contains controlled amounts of the cannabinoids. In addition to containing controlled amounts of the cannabinoids, the reconstituted plant material can also be designed to provide uniform deliveries of the cannabinoids in the aerosol generated from the material.

Another component that can be added to the reconstituted material are various flavorants, especially terpenes. A terpene or a blend of terpenes, for instance, can be used to develop desirable aromas and indicate to the user the quality of the product. One or more terpenes can also improve the sensory reaction to inhaling an aerosol created by the reconstituted material.

Various different terpenes can be applied to the reconstituted plant material. Such terpenes include but are not limited to pinene, hum ulene, b-caryophyllene, isopulegol, guaiol, nerylacetate, neomenthylacetate, limonene, menthone, dihydrojasmone, terpinolene, menthol, phellandrene, terpinene, geranylacetate, ocimene, myrcene, 1,4-cineole, 3-carene, linalool, menthofuran, perillyalcohol, pinane, neomenthylaceta, alpha-bisabolol, borneol, camphene, camphor, caryophyllene oxide, alpha-cedrene, beta-eudesmol, fenchol, geraniol, isoborneol, nerol, sabinene, alpha-terpineol, and mixtures thereof.

In one embodiment, various different terpenes can be blended together in order to mimic the ratios of terpenes found in natural cannabis plants. For instance, from about 2 to about 12 terpenes can be blended together and applied to the reconstituted plant material. Each terpene can be applied to the reconstituted plant material in an amount greater than about 0.001% by weight and generally less than about 2% by weight. For instance, each terpene can be applied in an amount from about 0.01% by weight to about 1.5% by weight. For instance, each terpene can be applied in an amount from about 0.1% to about 1.1% by weight.

Exemplary blends of terpenes include alpha-pinene, beta-caryophyllene, and beta-pinene; alpha-humulene, alpha-pinene, beta-caryophyllene, beta-pinene, and guaiol; beta-caryophyllene, beta-pinene, and d-limonene; beta-caryophyllene, beta-pinene, and nerolidol; beta-caryophyllene, beta-pinene, d-limonene, and terpinolene; alpha-bisabolol, alpha-pinene, beta-caryophyllene, beta-myrcene, beta-pinena, and d-limonene; beta-caryophyllene, beta-pinena, and p-cymene; alpha-humulene, beta-caryophyllene, beta-pinene, d-limonene, linalool, and nerolidol; beta-caryophyllene and beta-pinene; beta-caryophyllene, beta-myrcene, and terpinolene; alpha-pinene, beta-caryophyllene, beta-pinene, d-limonene; alpha-humulene, alpha-pinene, beta-caryophyllene, beta-myrcene, beta-pinena, d-limonene, and guaiol.

Aerosol delivery compositions containing one or more aerosol delivery agents as described above can be applied to the reconstituted plant material using any suitable method or technique. For instance, the aerosol delivery composition can be sprayed or coated onto the fiber substrate in any suitable manner.

Reconstituted plant materials made in accordance with the present disclosure have excellent mechanical characteristics and have a very desirable and aesthetic appearance. In general, the reconstituted plant material has a basis weight of greater than about 40 gsm, such as greater than about 45 gsm, such as greater than about 55 gsm. The basis weight of the reconstituted plant material is generally less than about 120 gsm, such as less than about 100 gsm, such as less than about 85 gsm.

In one embodiment, the reconstituted plant material of the present disclosure can be formed into a loose filler using various methods, such as extrusion or through cutting and/or shredding the reconstituted material. Filler material made in accordance with the present disclosure can have a filling power of greater than about 4 $cm^3/g$, such as greater than about 5 $cm^3/g$, such as greater than about 6 $cm^3/g$, and generally less than about 10 $cm^3/g$, such as less than about 8 $cm^3/g$. The reconstituted plant material can have excellent burn properties. For instance, the reconstituted plant material can have a static burn rate of greater than about 4 mm/mm, such as greater than about 5 mm/mm, and generally less than about 8 mm/mm, such as less than about 7 mm/mm.

The reconstituted plant material of the present disclosure has excellent taste characteristics while also being free from nicotine and producing relatively low amounts of tar, especially in comparison to conventional tobacco materials. Unexpectedly, it was also discovered that the reconstituted plant fiber material of the present disclosure does not produce a "papery" taste, even though the material may contain significant amounts of cellulose fibers, such as softwood fibers. Although unknown, it is believed that the extracted cocoa fibers mask or otherwise suppress any paper-like taste when the material is burned or otherwise heated. This discovery is surprising and completely unexpected.

Consequently, an aerosol generating material incorporating the reconstituted plant material of the present disclosure can be used in all different types of aerosol generating products. In one embodiment, for instance, the aerosol generating material of the present disclosure can be formed into a smokable rod and surrounded by an outer wrapper. The smoking article, or cigarette, can include a filter located at one end of the smoking article. However, because of the neutral and mild characteristics of an aerosol produced from the reconstituted plant material and because the reconstituted plant material has no harsh components and is low in nicotine and tar, cigarettes can be made according to the present disclosure can be filterless.

In one embodiment, the reconstituted plant material is formed on a paper forming machine and is in the form of a sheet. The sheet can then be cut into strips and fed to a rotating or agitated drum. When in the drum, the reconstituted plant material can be mixed with one or more humectants and a casing. The casing can contain various different flavorants or mainstream smoke enhancing elements. For instance, the casing may contain licorice, corn syrup, and/or sugar. From the drum, the reconstituted plant material can undergo a cutting or grinding process in order to reduce the material to a desired particle size. The cut reconstituted plant material is sometimes referred to as cut rag. Once cut to a desired size, various different aerosol delivery agents or flavorants can be applied to their reconstituted plant material. For instance, one or more terpenes can be applied to the reconstituted plant material and/or one or more cannabinoids, such as CBD and/or THC. Once the aerosol delivery agents are applied to the reconstituted plant material, the reconstituted plant material can be packaged and shipped for use in any suitable form. In one aspect, the reconstituted plant material can be fed to a cigarette making machine for forming the reconstituted plant material into rod-like elements. Alternatively, the material can be packaged in loose form and used as a filling for roll-your-own products, heat but not burn products, or snuff.

In addition to cigarettes, aerosol generating materials made according to the present disclosure can also include cigars and cigarillos.

The reconstituted plant material of the present disclosure can also be used to produce a snuff product. The snuff product can be a dry product or can contain substantial amounts of moisture.

When producing a snuff product, the product can be made exclusively from the reconstituted plant material of the present disclosure or can be formed from the reconstituted plant material of the present disclosure blended with other filler materials. When the reconstituted plant material of the present disclosure is used to form snuff, the amount of web building fibers contained in the product may be reduced. For instance, the amount of web building fibers can be less than about 5% by weight, such as less than about 3% by weight. In one aspect, the reconstituted plant material may not contain any web building fibers. In another embodiment, the reconstituted plant material contains web building fibers in an amount of from about 5% to about 50% by weight.

In order to form a snuff product, the reconstituted plant material of the present disclosure is ground or cut to a desired size. For instance, the particle size can be relatively small or can be made into strips depending upon the end use application. In one aspect, for instance, the material is cut or ground so as to have an average particle size of greater than about 50 microns, such as greater than about 100 microns, and generally less than about 3 mm, such as less than about 2 mm. Alternatively, the material can be ground into a powder or a granular material wherein the average particle size is less than about 100 microns.

If desired, the reconstituted plant material can be subjected to a heat treatment. The heat treatment may provide the material with texture and color and enhance the natural flavors. After an optional heat treatment step, additives such as pH-regulators and flavorings can be added to the mixture. When forming a moist smokeless product, water can be added to the product such that the water content is greater than about 10% by weight, such as greater than about 20% by weight, such as greater than about 30% by weight, such as greater than about 40% by weight, and generally less than about 60% by weight, such as less than about 50% by weight. If desired, one or more moisture agents can be added to the product that facilitates the moisture retaining properties of the blend. In one aspect, for instance, sodium chloride and/or sodium carbonate can be added to the reconstituted plant material Alternatively, the reconstituted plant material can be used to produce a dry snuff, such as a dry oral snuff. In order to produce a dry oral snuff, the material is ground into a powder to which other ingredients such as flavors are added.

In one aspect, the smokeless reconstituted cannabis material can be placed in an oral pouch that is intended for use in the oral cavity, such as by placing the pouch between the upper and lower gum of the lip or cheek. The oral pouched product may have an oblong shape, such as a rectangular shape. The total weight of the oral pouch can generally be in the range of from about 0.1 g to about 2.5 g, such as from about 0.2 g to about 0.8 g. The pouch can be made of any suitable saliva-permeable pouch material, such as a nonwoven. A binder may be included in the pouch to facilitate sealing of the material by ultrasonic welding. The binder, for instance, can be an acrylate polymer. In one aspect, the pouch can be formed from a nonwoven material containing regenerated cellulose fibers, such as viscose rayon staple fibers and a binder. If desired, the pouch material may also contain additional flavoring agents and/or colorants.

In one embodiment, smoking articles made according to the present disclosure can also have reduced ignition propensity characteristics. For instance, an outer wrapper of the smoking article can include a plurality of discrete reduced ignition areas spaced in the axial direction of the smoking article. For instance, in one embodiment, the discrete reduced ignition areas may be in the form of circular bands. The bands can have a width so that oxygen is limited to the burning coal for a sufficient length or period of time to extinguish the coal if the smoking article were left in a static burn condition. The bands, for instance, can have a width of generally greater than about 3 mm, such as greater than about 4 mm, such as greater than about 5 mm, and generally less than about 10 mm, such as less than about 8 mm, such as less than about 7 mm.

The spacing between the reduced ignition areas can also vary depending upon a number of variables. The spacing should not be so great that the cigarette burns for a sufficient length of time to ignite a substrate before the coal burns into a reduced ignition area. The spacing also affects the thermal inertia of the burning coal, or the ability of the coal to burn through the reduced ignition areas without self-extinguishing. In general, the band spacing should be greater than about 5 mm, such as greater than about 10 mm, such as greater than about 15 mm, and generally less than about 50 mm, such as less than about 40 mm, such as less than about 30 mm. Each smoking article can contain from about 1 to about 3 bands.

In general, any suitable ignition reducing composition can be applied to the outer wrapper of the smoking article. In one embodiment, for instance, the ignition reducing composition contains a film-forming material. For example, film-forming materials that can be used in accordance with the present invention include alginates, guar gum, pectin, polyvinyl alcohol, polyvinyl acetate, cellulose derivatives such as ethyl cellulose, methyl cellulose, and carboxymethyl cellulose, starch, starch derivatives, and the like.

In one particular embodiment, the film-forming material may comprise an alginate, alone or in combination with starch. In general, an alginate is a derivative of an acidic polysaccaride or gum which occurs as the insoluble mixed calcium, sodium, potassium and magnesium salt in the Phaeophyceae brown seaweeds. Generally speaking, these derivatives are calcium, sodium, potassium, and/or magnesium salts of high molecular weight polysaccarides composed of varying proportions of D-mannuronic acid and L-guluronic acid. Exemplary salts or derivatives of alginic acid include ammonium alginate, potassium alginate, sodium alginate, propylene glycol alginate, and/or mixtures thereof.

In one embodiment, a relatively low molecular weight alginate may be used. For example, the alginates may have a viscosity of less than about 500 cP when contained in a 3% by weight aqueous solution at 25° C. More particularly, the alginates may have a viscosity of less than 250 cP at the above conditions, particularly less than 100 cP, and in one embodiment at a viscosity of about 20-60 cP. As used herein, viscosity is determined by a Brookfield LVF Viscometer with a suitable spindle according to the viscosity. At the above lower viscosity levels, alginate compositions can be formed at a higher solids content, but yet at a low enough solution viscosity to permit the application of the composition to a paper wrapper using conventional techniques. For example, the solids content of an alginate solution made in accordance with the present invention can be greater than about 6%, particularly greater than about 10%, and more particularly from about 10% to about 20% by weight.

At the above solids levels, alginate compositions used in accordance with the present invention can have a solution viscosity of greater than about 250 cP, particularly greater than about 500 cP, more particularly greater than about 800 cP, and in one embodiment at a viscosity of greater than about 1,000 cP at 25° C. In general, the solution viscosity of the alginate film-forming composition can be adjusted depending upon the manner in which the composition is being applied to the wrapper. For instance, the solution viscosity of the composition can be adjusted depending upon whether or not the composition is being sprayed onto the wrapper or printed onto the wrapper.

In other embodiments, it should also be understood that depending upon the application a relatively high molecular weight alginate may be used. For example, the alginate may have a viscosity of greater than about 500 cP when contained in a 3% by weight aqueous solution at 25° C.

In addition to the film-forming material, the reduced ignition composition applied to the wrapper can contain various other ingredients. For instance, in one embodiment, a filler can be contained within the composition. The filler can be, for instance, calcium carbonate, calcium chloride, calcium lactate, calcium gluconate, and the like. In addition to calcium compounds, other various particles may be used including magnesium compounds such as magnesium oxide, clay particles, and the like.

The ignition reducing composition, in one embodiment, can be water based. In particular, the ignition reducing composition may comprise an aqueous dispersion or aqueous solution. Alternatively, the ignition reducing composition prior to being applied to the paper wrapper may comprise a non-aqueous solution or dispersion. In this embodiment, for instance, an alcohol may be present for applying the composition to the wrapper.

As opposed to a film-forming composition, the ignition reducing composition may also comprise a cellulose slurry (a type of dispersion). As used herein, a slurry containing papermaking materials is not a film-forming composition. The cellulose slurry applied to the paper substrate may comprise fibrous cellulose, one or more fillers, and/or cellulose particles. As used herein, cellulose fibers and cellulose particles are to be differentiated from derivatized cellulose such as carboxymethyl cellulose. Cellulose fibers and cellulose particles, for instance, are not water soluble. In one embodiment, the cellulose slurry applied to the wrapper may comprise microcrystalline cellulose.

Once the ignition reducing composition is formulated, the composition can be applied to a wrapper in discrete areas. The manner in which the composition is applied to the wrapper can vary. For example, the composition can be sprayed, brushed, applied with a moving orifice, or printed onto the wrapper. To form a treated area, the composition can be applied in a single pass or in a multiple pass operation. For instance, the composition can be applied to the wrapper in successive steps in order to form areas on the wrapper having reduced ignition proclivity. In general, during a multiple pass process, the treated areas can be formed by applying the composition during from about 2 to about 8 passes.

The amount of reduced ignition composition applied to the wrapper can also vary. For instance, the composition can be applied to the wrapper in an amount less than about 15% by weight, such as less than about 10% by weight, such as less than about 8% by weight. In general, the composition is applied in an amount greater than 1% by weight based upon the weight of the composition within the reduced ignition areas.

As used herein, the above weight percentages are based on the area treated with the chemical components. In other words, the weight percentages above for the reduced ignition composition is the amount applied within the treated areas as opposed to the total amount applied over the entire surface of the wrapper.

Through the process of the present disclosure, reduced ignition areas can be produced having a relatively high permeability while also having a relatively low diffusivity. For instance, the reduced ignition areas can have a permeability greater than 10 CORESTA while still being capable of producing smoking articles that pass ASTM Test E2187-09 at least 75% of the time.

In general, the reduced ignition areas have a diffusivity that is relatively low. The diffusivity can be measured at room temperature (23° C.). In general, the diffusivity at 23° C. of the reduced ignition areas is less than about 0.5 cm/s, such as less than 0.4 cm/s, such as less than 0.3 cm/s. In one embodiment, the reduced ignition areas may have a diffusivity of greater than about 0.05 cm/s, such as greater than about 0.15 cm/s, such as greater than 0.16 cm/s, such as greater than 0.17 cm/s, while still having the desired reduced ignition proclivity characteristics. Diffusivity is measured using a Sodim $CO_2$ diffusivity tester.

In addition to being incorporated into smoking articles, the aerosol generating material of the present disclosure can also be packaged and sold in various other forms to consumers. For instance, in one embodiment, the aerosol generating material can be packaged and sold as a filler material in the form of strips or shreds. The filler material can then be used in pipes, as a filler in a roll-your-own smoking article, or can be used in an aerosol generating device that heats but does not combust the material.

The present disclosure may be better understood with reference to the following examples.

EXAMPLES

The following test methods are used to not only define the various parameters but also were used in obtaining the results in the examples below.

Tests & Methods

Filling power and Equilibrium Moisture Content (EMC)

The sample of filler material is conditioned according to ISO 3402 (22° C.+/−1° C., 60%+/−3% R.H., during min. 48 hrs). After conditioning, the material is unfolded and cut into cut rag (equipment: BUROMA disc cutter; width: 0.7 mm).

To perform filling power analysis, 14 g of cut filler (precision: +/−0.01 g) is placed into a Borgwaldt cylinder (DM4625 model; diameter=5.98 cm, height=10.8 cm). A weight of 2 kg is applied during 60 sec. When the piston is released, the height of the filler column is displayed and recorded (H, in cm).

The filling power of the sample (in cc/g) is calculated as: 2×H.

Equilibrium Moisture Content is measured according to the following method: The weight of an empty pan (made of glass) is measured, at a precision of +/−1 mg, and recorded (T).

The pan is then filled with cut filler (between 5 and 7 g) and the weight of the pan with cut filler is recorded (W1, precision +/−1 mg).

The pan with cut filler is then dried in a Hearson oven (Mark V), during 3 hrs (+/−5 min), at 100° C.

After drying, the pan is cooled in a dessicator during 15 min and its weight is measured (W2, precision +/−1 mg). Moisture of the sample (%) is calculated as:

$$\frac{W1 - W2}{W1 - T} \times 100$$

Water Solubles Content

The sample of filler is ground into powder (using a IKA or RETSCHE-MUHLE grinder; mesh size: 1 mm).

A glass fiber filter (DURIEUX filter Nr 28, diam.=55 mm) is placed in a stainless steel pan. The tare of the pan+filter is then weighed (T, precision+/−1 mg). A 5000 mg (+/−200 mg) sample of ground filler is placed in the pan and precisely weighed (W1, precision+/−1 mg).

The ground filler is gently sprayed with water and the cup is installed into a lab percolator (RENEKA LC). Extraction is performed three times according to the pre-defined percolation settings. After percolation, the sample is cautiously washed with water and the pan is dried in an electric oven for 16 hrs at 100° C.

After washing, the pan is cooled in a dessicator during 15 min and its weight is measured (W3, precision+/−1 mg).

Dry weight of the ground sample used for Water solubles test (W2) is calculated as: W2=W1×(100−H)/100.

Finally, the ratio of Water solubles (%) in the dry finished product is calculated as follows:

$$WS(\%) = 1,15 \times \left(\left(\frac{W2 - (W3 - T)}{W2}\right) \times 100\right) - 2,0$$

Cigarettes Making

The sample of filler is conditioned according to ISO 3402 (22° C.+/−1° C., 60%+/−3% R.H., during min. 48 hrs). After conditioning, the filler sheets are cut into shreds (equipment: BUROMA disc cutter: width: 0.7 mm). The cut material is sieved on a laboratory sieve (mesh size: 1 mm).

Empty cigarettes tubes are then filled with 100% cut filler, using a hand rolling machine from PRIVILEG. The weight of cut filler is adjusted to reach a Pressure Drop of 100+/−5 mm WG.

The empty tubes have the following characteristics:

tube weight=200±5 mg, total length=84 mm, diameter=8.1±0.1 mm, tipping length=25 mm acetate filter (denier=3.0Y/35000HK, length=15±0.5 mm, pressure drop=43±3 mm WG), cigarette paper porosity=50 CU, no filter ventilation.

Cigarettes are then sorted on a SODIMAT machine. The lot of cigarettes selected to perform smoke analyses have the following characteristics: filler weight: average target weight +/−10 mg, pressure drop: average target PD+/−3.5 mm WG.

Before performing smoke analyses, cigarettes are conditioned according to ISO 3402 (22° C.+/−1° C., 60%+/−3% R.H., during min. 48 hrs).

Analysis of Combustibility 10 cigarettes are positioned on a FILTRONA static burn rate machine. This machine has 10 cigarette holders and 10 individual chronometers.

Two cotton threads, 40 mm away from each other, are settled right over the 10 cigarettes. Each thread is connected to the chronometer.

The cigarettes are lit sequentially. For each cigarette, when the combustion cone cuts the front cotton line, the chronometer is automatically activated. Once the char line reaches the second cotton thread, the chronometer automatically stops thus giving the time necessary to burn 40 mm of the filler rod.

An average time (in seconds) is calculated from the 10 chronometers.

The average combustibility (in mm/min) is calculated as:

$$\frac{40 \times 60}{\text{Average time}}$$

Analysis of Tar, Nicotine, Water and CO in Smoke 2 sets of 20 cigarettes are smoked on a Borgwaldt RM20 kit machine, in standard ISO conditions (ISO 3308).

Nicotine and water in smoke (mg/cig) are measured by Gas Chromatography, according to standards ISO 10315 and ISO 10362-1.

Tar in smoke (mg/cig) is measured according to standard ISO 4387.

CO in smoke (mg/cig) is measured by Non-Dispersive Infra-Red (NDIR) method, according to standard ISO 8454.

Example 1

A cocoa filler according to the present disclosure comprising fibers originating from a cocoa (*Theobroma cacao*) tree was manufactured according to the following method: cocoa husks were ground using a knife mill so as to obtain particles about 1 mm in size. The ground husk material was then mixed with water at 70° C. for 45 minutes, in a husk/water ratio of 1/10. The mixture was then pressed so as to separate the aqueous part (cocoa husk fluid) from the insoluble part (cocoa husk fibres). The fibrous fraction was refined using disc refiners. After refining, delignified fibres originating from resinous trees (softwood fibers) were added to the refined fibre fraction in a ratio of delignified fibres/fibres according to the invention from cocoa tree of 40%/60% so as to manufacture reconstituted cocoa filler sheets. The cocoa filler sheets were then dried.

Cocoa filler material showed the following characteristics:

| | Method | Cocoa Filler 60% cocoa fibres from husk + 40% cellulose fibres |
|---|---|---|
| Dry basis weight (g/m$^2$) | NF Q03 019 | 53 |
| Thickness (μm) | NF Q03 017 | 191.2 |
| Flexural strength 7.5° Machine Direction MD (mN) | ISO 2493-1, 2011 | 21.6 |
| Flexural strength 7.5° Cross Direction CD (mN) | ISO 2493-1, 2011 | 21.6 |
| Flexural strength 15° MD (mN) | ISO 2493-1, 2011 | 36.6 |
| Flexural strength 15° CD (mN) | ISO 2493-1, 2011 | 36.6 |
| Tensile Strength MD (kN/m) | ISO 1924-2 | 0.91 |
| Tensile Strength CD (kN/m) | ISO 1924-2 | 0.91 |
| Deformation before rupture MD (%) | ISO 1924-2 | 1.4 |
| Deformation before rupture CD (%) | ISO 1924-2 | 1.4 |
| Bursting Strength (KPa) | ISO 2758 | 47.4 |
| Hot water solubles (%) | See Definition Section | 2.9 |
| Filling value (at EMC 11.2%) | See Definition Section | 9.7 |

Example 2

A cocoa filler according to the present disclosure comprising fibres originating from cocoa (*Theobroma cacao*) tree was manufactured according to the following method: cocoa husks were ground using a knife mill so as to obtain particles about 1 mm in size. The ground husk material was then mixed with water at 70° C. for 45 minutes, in a husk/water ratio of 1/10. The mixture was then pressed so as to separate the aqueous part (cocoa husk fluid) from the insoluble part (cocoa husk fibres). The fibrous fraction was refined using disc refiners. After refining, delignified fibres originating from resinous trees (softwood fibers) were added to the refined fibre fraction in a ratio of delignified fibres/fibres to cocoa husk fibers of 40%/60% so as to manufacture reconstituted cocoa filler sheets. The cocoa filler sheets were then dried. In parallel, the aqueous portion prepared as above, and originating from cocoa tree (coco husk fluid), also called "extracts" was concentrated in an evaporator to a solid concentration of 20% to be then coated or not on cocoa filler sheets by coating with a size press. Before being dried, various other substances are also added to the cocoa filler sheets by coating and/or spraying according to the table below:

| | |
|---|---|
| A | 97% Cocoa filler/3% Aroma 1 added by spraying |
| B | 97% Cocoa filler/3% Aroma 2 added by spraying |
| C | 97% Cocoa filler/3% Aroma 3 added by spraying |
| D | 97% Cocoa filler/3% Aroma 4 added by spraying |
| E | 97% Cocoa filler/3% Aroma 5 added by spraying |
| F | 72% Cocoa filler/Addition of 26% cocoa husk fluid from Example 2 + 2% inverted sugar |
| G | 59% Cocoa filler/Addition of 26% cocoa husk fluid from Example 2/15% vegetal glycerin |
| H | 97% Cocoa filler/3% Aroma 6 added by spraying |

Some cigarettes (A, B, C, D, E, F, H) were made for sensory evaluation purposes by a group of experts. A G sample was evaluated in a PAX 3 system for Heat-not-Burn application.

The following results were obtained:

| | |
|---|---|
| A | Nice aroma: citrus, floral, cannabis<br>Very little irritation |
| B | Very little aroma before cigarette lighting<br>Very close to basic cocoa filler |
| C | Very little aroma before cigarette lighting<br>Some mouth coating<br>Slightly irritant, close to tobacco experience |
| D | Very little aroma before cigarette lighting<br>Important mouth coating. Some acidity and floral notes.<br>Good level of irritation<br>Nice smoke odor |
| E | Very little aroma before cigarette lighting<br>Strong cannabis smoke odor and taste<br>Astringent |
| F | Stronger tobacco notes but higher irritation and some bitterness |
| G | Very strong but pleasant chocolate notes<br>Nice smoke volume<br>Long lasting taste<br>No irritation |
| H | Very little aroma before cigarette lighting<br>Very close to basic cocoa filler |

Example 3

A cocoa filler according to the present disclosure comprising fibres originating from cocoa (*Theobroma cacao*) tree was manufactured according to the following method: cocoa husks were ground using a knife mill so as to obtain particles about 1 mm in size. The ground husk material was then mixed with water at 70° C. for 45 minutes, in a husk/water ratio of 1/10. The mixture was then pressed so as to separate the aqueous part (cocoa husk fluid) from the insoluble part (cocoa husk fibres). The fibrous fraction was refined using disc refiners. After refining, delignified fibres originating from resinous trees (softwood fibers) were added to the refined fibre fraction in a ratio of delignified fibres/fibres to cocoa tree of 40%/60% so as to manufacture reconstituted cocoa filler sheets. The cocoa filler sheets were then dried.

Tobacco extract coming from Tobacco material prepared as above in order to use aqueous part (tobacco fluid), also called tobacco "extracts". Those extracts were then added to the cocoa filler sheets by coating. Some reconstituted tobacco material was also manufactured according to the same methodology for the purpose of demonstration The following samples were made:

| | |
|---|---|
| A | 55% Cocoa filler/30% Tobacco extract/15% glycerin |
| B | 63% Cocoa filler/22% Tobacco extract/15% glycerin |
| D | 60% Cocoa filler/40% Tobacco extract |
| E | Control: 60% Tobacco fibers/40% Tobacco extract |
| F | Control: 55% Tobacco fibers/30% Tobacco extract/15% glycerin |

Sensory Evaluation

Sample A was compared to Sample F in Heat-not-Burn device (PAX3). No significant difference. Cocoa filler is neutral. It can replace tobacco fibers.

Sample D was compared to Sample E in conventional cigarettes conditions. No significant difference. Cocoa filler is neutral. It can replace tobacco fibers.

Sample A was compared to Sample B in Heat-not-Burn device. As expected, tobacco notes and nicotine impact is lower on sample B.

Example 4

A cocoa and tobacco filler according to the present disclosure comprising fibres originating from cocoa (*Theobroma cacao*) tree and Tobacco (Nicotania tabcum) plant was manufactured according to the following method: cocoa husks were ground using a knife mill so as to obtain particles about 1 mm in size. The ground husk material was then mixed with water at 70° C. for 45 minutes, in a husk/water ratio of 1/10. The mixture was then pressed so as to separate the aqueous part (cocoa husk fluid) from the insoluble part (cocoa husk fibres). The fibrous fraction was refined using disc refiners. After refining, delignified fibres originating from resinous trees and tobacco fibres prepared as above were added to the refined fibre fraction in a ratio of delignified fibres/tobacco fibres/cocoa fibres of 20%/60%/20% so as to manufacture cocoa and tobacco filler sheets. The cocoa and tobacco filler sheets were then dried.

In parallel, the aqueous portion prepared as above, and originating from Tobacco plant (tobacco fluid), also called tobacco "extracts" was concentrated in an evaporator to a solid concentration of 50% to be then coated or not on the cocoa and tobacco filler sheet by coating with a size-press and later dried. Some reconstituted tobacco material were also manufactured according to the same methodology for the purpose of demonstration.

The following samples were made:

| | |
|---|---|
| C | 55% Cocoa & tobacco filler + 30% Tobacco extract + 15% glycerin |
| F | Control—55% Tobacco fibers + 30% Tobacco extract + 15% glycerin |

Sensory Evaluation

Sample C was compared to Sample F in Heat-not-Burn device (PAX3). No significant difference. Cocoa filler is neutral and can replace tobacco fibers.

Example 5

A cocoa filler according to the present disclosure comprising fibres originating from cocoa (*Theobroma cacao*) tree was manufactured according to the following method: cocoa husks were ground using a knife mill so as to obtain particles about 1 mm in size. The ground husk material was then mixed with water at 70° C. for 45 minutes, in a husk/water ratio of 1/10. The mixture was then pressed so as to separate the aqueous part (cocoa husk fluid) from the insoluble part (cocoa husk fibres). The fibrous fraction was refined using disc refiners. After refining, delignified fibres originating from resinous trees (softwood fibers) were added to the refined fibre fraction in a ratio of delignified fibres/cocoa husk fibres of 40%/60% so as to manufacture reconstituted cocoa filler sheets. The cocoa filler sheets were then dried.

In parallel, the aqueous portion prepared as above, and originating from hemp (*Cannabis* spp.) plant (hemp fuild), also called hemp "extracts" was concentrated in an evaporator to a solid concentration of 50% to be then coated on cocoa filler sheet by coating with a size-press and later dried.

Samples were made as follows:

| | |
|---|---|
| C | 67% Cocoa filler + 33% Hemp extract |
| D | 57% Cocoa filler + 28% Hemp extract + 15% glycerin |

Sensory Evaluation

Sample C was evaluated in conventional cigarette conditions. Nice smoke volume, good combustion and smell. No irritation. Little bitterness. Good Hemp notes—no Cocoa notes. Cocoa fibres are neutral.

Sample D was compared in Heat-not-Burn device. Very good smoke volume. Distinctive Hemp/cannabis flavors with no cocoa notes. No irritation. Very pleasant. Cocoa fibres are neutral.

As described above, various different aerosol generating materials can be made in accordance with the present disclosure. In one embodiment, the aerosol generating material comprises a reconstituted plant material containing extracted cannabis fibers combined with extracted tobacco fibers. In an embodiment, the reconstituted plant material may contain extracted cannabis fibers with extracted herbal plant fibers. In an embodiment, the reconstituted plant material may contain extracted cannabis fibers combined with extracted tobacco fibers and extracted herbal plant fibers.

In an embodiment, the aerosol generating material may comprise a reconstituted plant material containing extracted plant fiber fibers combined with extracted tobacco fibers. In an embodiment, the reconstituted plant material may contain extracted plant fiber fibers combined with extracted herbal plant fibers. In an embodiment, the reconstituted plant material may comprise extracted plant fiber fibers combined with extracted tobacco fibers and extracted herbal plant fibers.

In an embodiment, the aerosol generating material may comprise a reconstituted plant material containing extracted cannabis fibers, extracted plant fiber fibers, extracted tobacco fibers, and extracted herbal plant fibers. In an embodiment, the reconstituted plant material may contain extracted cannabis fibers and extracted plant fiber fibers combined with extracted tobacco fibers. In an embodiment, the reconstituted plant material may contain extracted cannabis fibers, extracted plant fiber fibers, and extracted herbal plant fibers.

In any of the above embodiments, the reconstituted plant material can further contain web building fibers.

The web building fibers combined with the reconstituted plant material in any of the embodiments described above can vary. In an embodiment, the web building fibers are pulp fibers, such as softwood fibers, hardwood fibers, or mixtures thereof. In an embodiment, the web building fibers contain softwood fibers and hardwood fibers in a ratio of from 1:2 to 2:1. In an embodiment, the web building fibers comprise flax fibers. In an embodiment, the web building fibers are abaca fibers. In an embodiment, the web building fibers are bamboo fibers. In an embodiment, the web building fibers are coconut fibers. In an embodiment, the web building fibers are ramie fibers. In an embodiment, the web building fibers are jute fibers. In an embodiment, the web building fibers are hemp pulp fibers. The hemp pulp fibers can be used alone or in combination with wood pulp fibers, such as softwood fibers, hardwood fibers, or mixtures thereof. In an embodiment, the web building fibers are present in the aerosol generating material in an amount greater than about 3% by weight. In an embodiment, the web building fibers are present in the aerosol generating material in an amount greater than 5% by weight. In an embodiment, the web building fibers are present in the aerosol generating material in an amount greater than about 8% by weight. In an embodiment, the web building fibers are present in the aerosol generating material in an amount greater than about 12% by weight. In an embodiment, the web building fibers are present in the aerosol generating material in an amount greater than about 18% by weight. In an embodiment, the web building fibers are present in the aerosol generating material in an amount less than about 50% by weight, such as in an amount less than about 40% by weight.

In an embodiment, the aerosol generating material can include an aerosol delivery composition applied to the reconstituted plant material. The aerosol delivery composition contains an aerosol delivery agent. In an embodiment, the aerosol delivery agent comprises a drug or a flavorant. The aerosol delivery composition can be an oil, an aqueous solution, an aqueous dispersion, or a solid in any of the embodiments described herein. In an embodiment, the aerosol delivery agent comprises nicotine. In an embodiment, the aerosol delivery agent comprises a cannabinoid. In an embodiment, the aerosol delivery agent comprises tetrahydrocannabinol. In an embodiment, the aerosol delivery agent comprises cannabidiol. In an embodiment, the aerosol delivery agent comprises a combination of tetrahydrocannabinol and cannabidiol. Nicotine or a cannabinoid can also be combined with other aerosol delivery agents. In an embodiment, the other aerosol delivery agent is sugar. In an embodiment, the other aerosol delivery agent comprises a licorice extract. In an embodiment, the other aerosol delivery agent comprises honey. In an embodiment, the other aerosol delivery agent comprises coffee. In an embodiment, the other aerosol delivery agent comprises maple syrup. In an embodiment, the other aerosol delivery agent comprises a plant extract, such as a tea extract or a botanical extract. In an embodiment, the other aerosol generating agent comprises a tobacco extract. In an embodiment, the aerosol delivery agent comprises a tobacco extract alone. In an embodiment, the aerosol delivery composition contains a terpene or a blend of terpenes. A terpene or a blend of terpenes can be used with any of the aerosol delivery agents described above including nicotine or a cannabinoid.

The aerosol delivery composition containing one or more aerosol delivery agents can be present in the reconstituted plant material in an amount greater than about 1% by weight. In an embodiment, one or more aerosol delivery agents are present in an amount greater than about 3% by weight, such as in an amount greater than about 5% by weight. One or more aerosol delivery agents can be present on the reconstituted plant material in any of the embodiments described above in an amount less than about 50% by weight, such as in an amount less than about 25% by weight.

In an embodiment, the aerosol generating material can comprise a reconstituted plant material blended with another material. For example, in an embodiment, the aerosol generating material comprises a reconstituted plant material containing extracted cannabis fibers blended with a tobacco material. In an embodiment, the reconstituted plant material may contain extracted plant fiber fibers that is blended with a tobacco material. In an embodiment, the reconstituted plant material may comprise extracted cannabis fibers combined with an herbal material. In an embodiment, the reconstituted plant material may comprise extracted plant fiber fibers combined with an herbal material. In an embodiment, the aerosol generating material may comprise a reconstituted plant material containing extracted cannabis fibers combined with extracted plant fiber fibers and mixed with or blended with a tobacco material. In an embodiment, the aerosol generating material may comprise a reconstituted plant material containing extracted cannabis fibers and extracted plant fiber fibers combined with or blended with an herbal material. In an embodiment, the aerosol generating material may comprise a reconstituted plant material containing extracted cannabis fibers blended with a tobacco material and an herbal material. In an embodiment, the aerosol generating material may comprise a reconstituted plant material containing extracted plant fiber fibers blended with a tobacco material and an herbal material.

The tobacco material described above can be cut leaf tobacco. When the aerosol generating material contains extracted cannabis fibers, the extracted cannabis fibers can comprise extracted byproducts that have undergone an additional water soluble extraction.

In an embodiment, the reconstituted plant material contains the extracted plant fiber fibers that comprise tobacco fibers. The reconstituted plant material further comprises an aerosol delivery composition containing an aerosol delivery agent. The aerosol delivery agent can comprise nicotine, tetrahydrocannabinol, cannabidiol, or mixtures thereof.

The aerosol generating material in any of the embodiments described above can be used in numerous different products. In an embodiment, the aerosol generating material of any of the above embodiments can be formed into a smokable rod surrounded by an outer wrapper to form a smoking article. The smoking article can optionally include a filter located at one end. Optionally, the wrapper can include a plurality of discrete reduced ignition areas.

In an embodiment, any of the aerosol generating materials described above can be used in a heat but not burn device.

In any of the aerosol generating material embodiments described above, the aerosol generating material can be used as a snuff product.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed is:

1. An aerosol generating material comprising:

a reconstituted plant material containing a mixture of at least two different plant fibers, the reconstituted plant material containing:

(1) extracted cannabis fibers comprising cannabis leaves, cannabis hurds, cannabis buds, cannabis flowers, cannabis seeds, or by-products or residues of cannabis extraction, or mixtures thereof and wherein a weight ratio between the cannabis leaves and the cannabis hurds contained in the extracted cannabis fibers and the cannabis buds and/or cannabis flowers contained in the extracted cannabis fibers is from about 1:8 to about 8:1; the extracted cannabis fibers optionally being combined with extracted plant fiber fibers;

the reconstituted plant material further comprising:

(2) (a) extracted tobacco fibers comprising tobacco leaves, tobacco hurds, by-products of tobacco extraction, or mixtures thereof; or (b) extracted herbal plant fibers; or (c) mixtures thereof wherein the reconstituted plant material further comprises web building fibers comprising delignified cellulose fibers, wherein the web building fibers are present in the reconstituted plant material in an amount greater than about 3% by weight and less than about 40% by weight.

2. An aerosol generating material as defined in claim 1, wherein the reconstituted plant material contains the extracted cannabis fibers combined with the extracted tobacco fibers.

3. An aerosol generating material as defined in claim 1, wherein the reconstituted plant material contains the extracted plant fiber fibers and the extracted tobacco fibers.

4. An aerosol generating material as defined in claim 1, wherein the reconstituted plant material contains the extracted herbal plant fibers, the extracted herbal plant fibers being obtained from coffee, tea, vine, ginger, ginkgo, chamomile, tomato, ivy, mate, rooibos, cucumber, a cereal, turmeric, clove, licorice, sandalwood, cinnamon, mint, cilantro, cumin, thyme, or mixtures thereof.

5. An aerosol generating material as defined in claim 1, wherein the reconstituted plant material has been treated with a humectant, wherein the humectant is present in the reconstituted plant material in an amount of about 10% by weight or greater and in an amount of about 50% or less.

6. An aerosol generating material as defined in claim 1 wherein the extracted cannabis fibers contain less than 0.3% by weight tetrahydrocannabinol.

7. An aerosol generating material as defined in claim 1, further comprising an aerosol delivery composition applied to the reconstituted plant material, the aerosol delivery composition containing an aerosol delivery agent.

8. An aerosol generating material as defined in claim 7, wherein the aerosol delivery agent comprises nicotine, tetrahydrocannabinol, cannabidiol, a terpene, or mixtures thereof.

9. An aerosol generating material as defined in claim 1, wherein the aerosol generating material is in the form of a filler material comprising a strip, strips, shreds, or mixtures thereof of the reconstituted plant material.

10. A smoking article comprising an outer wrapper surrounding a smokable rod, the smokable rod comprising the aerosol generating material of claim 1.

11. A smoking article comprising a heating device and a chamber, the chamber containing the aerosol generating material as defined in claim 1, the heating device being positioned so as to heat the aerosol generating material for producing an inhalable aerosol without burning the aerosol generating material.

12. An aerosol generating material as defined in claim 1, wherein the reconstituted plant material contains water soluble extracts in an amount of 40% by weight or less.

13. An aerosol generating material comprising:

a reconstituted plant material containing a mixture of at least two different plant fibers, the reconstituted plant material containing:

(1) extracted cannabis fibers comprising cannabis leaves, cannabis hurds, cannabis buds, cannabis flowers, cannabis seeds, or by-products or residues of cannabis extraction, or mixtures thereof and wherein a weight ratio between the cannabis leaves and the cannabis hurds contained in the extracted cannabis fibers and the cannabis buds and/or cannabis flowers contained in the extracted cannabis fibers is from about 1:8 to about 8:1; the extracted cannabis fibers optionally being combined with extracted plant fiber fibers;

the reconstituted plant material further comprising:

(2) (a) extracted tobacco fibers comprising tobacco leaves, tobacco hurds, by-products of tobacco extraction, or mixtures thereof; or (b) extracted herbal plant fibers; or (c) mixtures thereof wherein the reconstituted plant material comprises cannabis leaves and hurds in an amount greater than about 10% by weight and less than about 70% by weight.

14. An aerosol generating material as defined in claim 13, wherein the reconstituted plant material contains water soluble extracts in an amount of 40% by weight or less.

* * * * *